US008015908B2

(12) United States Patent
Kline et al.

(10) Patent No.: US 8,015,908 B2
(45) Date of Patent: Sep. 13, 2011

(54) FIREARM SILENCER AND METHODS FOR MANUFACTURING AND FASTENING A SILENCER ONTO A FIREARM

(75) Inventors: Korey Kline, Miami, FL (US); Cole Lyons Crockwell, Miami, FL (US); Kevin W. Smith, Coral Gables, FL (US); Matthew A. Palmer, Miami, FL (US)

(73) Assignee: Alien Arms, LLC, Miami, FL (US)

( * ) Notice: Subject to any disclaimer, the term of this patent is extended or adjusted under 35 U.S.C. 154(b) by 80 days.

(21) Appl. No.: 12/389,984

(22) Filed: Feb. 20, 2009

(65) Prior Publication Data

US 2011/0186377 A1 Aug. 4, 2011

Related U.S. Application Data

(60) Provisional application No. 61/030,078, filed on Feb. 20, 2008.

(51) Int. Cl.
*F41A 21/00* (2006.01)

(52) U.S. Cl. ..... 89/14.4; 181/223

(58) Field of Classification Search ..... 89/14.4; 181/223

See application file for complete search history.

(56) References Cited

U.S. PATENT DOCUMENTS

| | | | | |
|---|---|---|---|---|
| 5,029,512 | A * | 7/1991 | Latka | 89/14.4 |
| 6,374,718 | B1 * | 4/2002 | Rescigno et al. | 89/14.4 |
| 7,237,467 | B1 * | 7/2007 | Melton | 89/14.4 |
| 7,587,969 | B2 * | 9/2009 | Silvers | 89/14.4 |
| 2008/0148928 | A1 * | 6/2008 | McClellan | 89/14.4 |
| 2008/0271944 | A1 * | 11/2008 | Brittingham | 181/223 |
| 2010/0000398 | A1 * | 1/2010 | Silvers | 89/14.4 |
| 2010/0126334 | A1 * | 5/2010 | Shults et al. | 89/14.4 |
| 2010/0163336 | A1 * | 7/2010 | Presz et al. | 181/223 |
| 2010/0180759 | A1 * | 7/2010 | Petersen | 89/14.4 |

* cited by examiner

*Primary Examiner* — Michael Carone
*Assistant Examiner* — Samir Abdosh
(74) *Attorney, Agent, or Firm* — Mayback & Hoffman, P.A.; Gregory L. Mayback; Rebecca A. Tie

(57) ABSTRACT

A firearm suppressor includes a unitary, hollow outer can and a monolithic extruded baffle. The outer can has an interior-threaded proximal end and a radially closed distal end with a longitudinal bore opening the interior of the can to the environment. The monolithic extruded baffle has a proximal end having outer circumferential threads shaped to secure removably inside the proximal end of the outer can and defines a proximal longitudinal bore shaped to receive at least a portion of the firearm barrel and removably secure thereto a distal end defining a distal longitudinal bore with a diameter sufficient to permit a projectile to pass therethrough. The baffle has central baffle walls disposed between the proximal end and the distal end. Each baffle wall has a longitudinal bore axially aligned with the proximal longitudinal bore and the distal longitudinal bore.

18 Claims, 15 Drawing Sheets

2610
2910
2600
2900

FIREARM SILENCER AND METHODS FOR MANUFACTURING AND FASTENING A SILENCER ONTO A FIREARM

CROSS-REFERENCE TO RELATED APPLICATION

This application claims the priority, under 35 U.S.C. §119, of U.S. Provisional Patent Application Ser. No. 61/030,078 filed Feb. 20, 2008, the entire disclosures of which is hereby incorporated herein by reference in its entirety.

STATEMENT REGARDING FEDERALLY SPONSORED RESEARCH OR DEVELOPMENT n/a

FIELD OF THE INVENTION

This disclosure relates generally to firearms and, more particularly, to a firearm silencer and methods for manufacturing and fastening a silencer onto a barrel of a firearm.

BACKGROUND OF THE INVENTION

The terms used below, such as front and back, or front and rear, relate to the firing direction, with the front pointing in the firing direction, the back pointing away from the firing direction. Where proximal or distal are used to explain a feature, proximal will refer to herein as the back and the distal will refer to herein as the front.

Traditionally, silencers (also referred to as suppressors) have been built with an outer tube and internal baffling components. The outer tube is steel or aluminum tubing and has end caps, either welded or threaded in place. The internal components are typically a set of flat disks each having a hole through the center thereof with spacers therebetween to create a volume of space (referred to as a baffle chamber) between each set of disks. Improvements on the flat spacer configuration include various expansion cone shape baffles that are either machined or stamped. Some of these baffles include holes at various places to re-direct gases and increase turbulence of the gases internally as the bullet passes thought the baffles. Such a configuration aids in reducing the noise produced by the firearm.

The pieces of the outer tube attach in a gas-tight manner onto, for example, an outside thread on the muzzle of a rifle. The disks extend in a plane that is orthogonal to the firing axis of the barrel. The firing opening of the disks can taper outward towards the front.

More modern suppressors that make use of what are referred to as "M" and "K" baffles incorporate both the expansion cone concept with the spacer as a single unit. These units are individually machined on a Computer Numerical Control (CNC) lathe and stacked on top of one another and are subject to stack-up tolerances during assembly. Recent designs include a monolithic baffle that is either drilled or milled from a round piece of stock. For example, U.S. Pat. Nos. 6,079,311 and 6,302,009 to O'Quinn et al. describe a monolithic baffle drilled or milled from a round piece of stock.

Characteristics of designing a suppressor include the number and the shape of the chamber parts. Each silencer also must be adapted to the weapon and to the ammunition used in the weapon. Another aspect to consider in this context is the silencer's sound-reducing requirements. Each chamber part reduces the muzzle report by a given amount and, therefore, a larger number of chambers is desirable. However, because the silencer increases the total length of the firearm and adds weight to the muzzle (thus impairing the weapon's balance), overall, the silencer should be as short and light as possible. Although different weapons may have the same caliber and muzzle shapes, it is still necessary to manufacture and stock many silencers with different lengths, in order to meet all requirements. This heavy expenditure is a disadvantage.

All of these methods for building a suppressor are very labor and cost intensive, thus resulting in a high production cost for the suppressor. Also, production in this way requires a significant amount of time. Currently the demand for silencers is exceeded by the capacity of the manufacturers and has resulted in waiting times as long as eight (8) months. Thus, it would be desirable to reduce the machine time and component count to a minimum and to be able to build a silencer that is mass-produced with corresponding lower costs while still having comparable performance.

Therefore, a need exists to overcome the problems with the prior art as discussed above.

SUMMARY OF THE INVENTION

The invention overcomes the above-noted and other deficiencies of the prior art by providing a firearm silencer and methods for manufacturing and fastening a silencer onto a firearm that has a significantly reduced machine time and that reduces the component count to the lowest possible. This suppressor can be mass-produced and, therefore, lowers costs dramatically while still performing comparably to prior art suppressors.

The invention creates the novel suppressor with two parts. A first part is an outer suppressor can that, in its final form has a cylindrical bottle-type shape with a proximal end entirely open and a distal end closed except for a central distal hole through which the projectile will pass into the environment. The second part is an inner baffle having a proximal end to be attached removably to a barrel of the firearm. The suppressor can slides over the inner baffle and attaches thereto at the proximal end of the inner baffle near the firearm. When attached thereto, the central axes of both the suppressor can and the inner baffle are coaxial with the central axis of the firearm barrel.

The distal end of the inner baffle defines a distal throughbore that is coaxial with the central distal hole of the outer suppressor can when the two parts are connected together. The proximal end of the inner baffle similarly defines a proximal throughbore that is coaxial with the central distal hole of the outer suppressor can when the two parts are connected together. In the exemplary embodiment, the hole can be sufficiently large enough to permit passage of at least a portion of the firearm barrel where, in an exemplary embodiment, the silencer is envisioned to connect to the firearm at a proximal distance away from the end of the barrel.

The extruded baffle form defines a number of baffle chamber walls between the two ends of the baffle. These baffle chamber walls extend substantially in the transverse (left-right) direction to, thereby, define a number of baffle chambers within the inner baffle. Each of the baffle chamber walls has a central throughbore that is axially aligned with the central distal hole of the suppressor can, the barrel axis of the firearm, and the central throughbores of the baffle's distal and proximal ends when all are connected together. In this way, a central coaxial projectile path is defined by all of the distal, proximal, and central throughbores of the inner baffle, the central distal hole of the suppressor can, and the barrel of the firearm.

The invention simplifies manufacture of the outer suppressor can in a significant way. The outer can on many prior art silencers is made from either aluminum or steel and involves taking a straight piece of tubing and welding or threading end closures in place after the baffle is inserted therein. Other prior art silencer designs have used two cup-shaped cans that telescope inside one another and are welded together to trap the baffles in place therebetween. To insure that individual suppressor parts are not re-assembled incorrectly, some of the thread-together prior art outer cans designs are staked permanently closed. Some suppressor designs also require spot-welding or other attachment methods to secure the baffle to the inside of the outer tube. But all of these welded and staked configurations share a disadvantage—they cannot be disassembled and cleaned or repaired as needed or desired.

To reduce the part count and the time for machining, the invention utilizes outer tubes (e.g., cans) that are deep drawn or spun as a single part. This operation is similar to the process for manufacturing aluminum $CO_2$ paintball gun tanks, steel scuba tanks, and aluminum baseball bats, to name a few. Because aluminum or steel is used, the deep drawn suppressor can tube can have a straight wall (parallel to the longitudinal axis of the barrel), can be slightly tapered (outward or inward), or can be stepped (outward or inward). The bottom of the suppressor can be shaped as needed. It can be, for example, flat or have some other useful shape like an expansion cone, a muzzle brake, and/or a flash hider. The manufacturing process applied to the suppressor can of the invention also allows the manufacturer to precisely control the wall thickness. In one exemplary embodiment of a suppressor can, the open (rear) end can have a larger wall thickness so that a single thread can be machined subsequently for attaching the monolithic baffle to the suppressor can. Another exemplary embodiment of the suppressor can uses a standard $CO_2$ tank made, for example, by Parker Cliff Division. In such an embodiment, the open end of the tank is removed to create the open (rear) end and is threaded for removable connection to the baffle.

The suppressor of the invention applies a monolithic extrusion for the inner baffle to drastically reduce the amount of machining needed for a final product. There are a few suppressors out on the market using a monolithic baffle concept—i.e., making the baffle from a single piece. The big disadvantage to this manufacturing process is the extreme amount of machine time that is required to fabricate the baffle. Simply put, a manufacturer takes a solid round bar stock and machines away 90% of the metal to form the cavities that will be used to absorb and slow down the firearm's exhaust gases. As is apparent, this machining is time intensive and requires extensive and expensive machining resources. Each of these requirements increases the cost associated with producing a single suppressor, which results in a low per-unit-time baffle production time schedule that cannot keep up with current demand.

The instant invention significantly reduces the manufacturing time to produce the inner baffle by creating the basic shape of the baffle using an extrusion. The invention applies the novel application of individually sawing off separate inner baffles from a single extruded part. More specifically, each individual baffle pre-form is cut off from the extrusion as a rectangular column having a square cross-section. The longitudinal axis of each inner baffle is orthogonal to the extrusion's longitudinal extent. This means that the extrusion defines all of the multiple baffle chamber walls along its extent. Therefore, when separated from the extrusion as a rectangular column, the baffle chambers are already present and need no additional machining. The sawing occurs in a direction transverse to the extrusion direction. In this way, an extrusion can be created to form the inner baffle walls in a machining-free process—thus reducing considerably the time and man-hours required for producing each silencer.

In comparison to the prior art where the entirety of the bar stock is machined, the only operations needed to finalize the inventive rectangular pre-form inner baffle are:

(1) turning the rectangular column to round the outside surface to an exterior circular diameter sufficient to fit inside the exterior housing of the suppressor can;
(2) drilling a longitudinal projectile hole with a sufficient diameter to allow for projectile clearance;
(3) creating a thread at an inside portion of the baffle adapter area for attaching the suppressor to the firearm; and
(4) creating a thread on the outside portion of the baffle adapter area for securing the exterior housing can to the baffle adapter.

All of these operations can be performed on a CNC lathe with a single setup operation. Minor operations for gas redirection can also be included as desired.

Because an extrusion can be formed in long sheets (or forms) and then cut to length for use, one single 10-foot long extrusion, for example, can create sixty (60) 2-inch wide inner baffle pre-forms. Significantly, each of these baffle pre-forms has approximately seventy-five percent (75%) of the machining already complete. Compared to the time required to machine sixty (60) prior art baffles to the same condition results in an astounding savings of manpower and cost.

Because of the nature of extrusions, it is acknowledged that there may be a limitation to two-dimensional baffle patterns, such as a chevrons pattern (as compared to a true conical expansion cone as used on a "K" or "M" baffle). But, there is an additional advantage to the two-dimensional patterns because baffles with staggered chevrons or re-directing baffles and dead end traps could be added. This is not easily made possible with prior art three-dimension-turned baffles. With the addition of these options for baffle configurations, the inventive suppressor will be comparable in performance to a non-extrusion prior art design but with a significantly lower cost and a significantly faster production time.

The invention also improves upon the prior art by providing an embodiment that renders superfluous a firearm barrel part. Traditionally, suppressors attach to the end of a threaded barrel or a tri-lug mount barrel. Another form of silencer, referred to as an integral silencer, includes some or the entire barrel included as internal parts of the silencer, as on a Heckler & Koch MP-SSD, for example. The inner baffle of the invention, in particular, replaces the barrel nut required for an AR15 or M16 style weapon in 9 MM and .45 ACP but it is not limited to these calibers. Other possible calibers include 5.56, 7.62, and 5.45. One exemplary embodiment shown in the figures includes a 9 mm with a "blow back" configuration. More specifically, a threaded end of the inventive monolithic baffle adapter can be used (1.25-18) to replace a nut that was previously used on an AR15/M16 to hold the barrel in place. In such a configuration, the entire barrel resides inside the silencer body to form an integral silencer. The barrel can be any length and can be either pinned permanently to the baffle or be removable and replaceable. This configuration allows a smooth and rigid transition from the upper firearm receiver to the silencer without cantilevering the weight of the silencer on the barrel, which could adversely affect accuracy. As such, the balance of the firearm remains proportional.

What is referred to in the art as an outer heat shield could also be trapped between the receiver and the inventive baffle to act as a hand guard or a picatinny rail system for a vertical hand guard. This embodiment for replacing the barrel nut does not prevent the use of a standard threaded-barrel attachment process. Rather, it provides an alternative configuration that allows a thread to be incorporated into the rear of the baffle adapter, in which case, the barrel nut becomes superfluous.

With the foregoing and other objects in view, there is provided, in accordance with the invention, a firearm suppressor including a unitary or one-piece, hollow outer can and a monolithic extruded baffle. The outer can has an interior-threaded proximal end and a radially closed distal end with a longitudinal bore opening the interior of the can to the environment. The monolithic extruded baffle has a proximal end having outer circumferential threads shaped to secure removably inside the proximal end of the outer can and defines a proximal longitudinal bore shaped to receive at least a portion of the firearm barrel and removably secure thereto a distal end defining a distal longitudinal bore with a diameter sufficient to permit a projectile to pass therethrough and central baffle walls disposed between the proximal end and the distal end. Each baffle wall has a longitudinal bore axially aligned with the proximal longitudinal bore and the distal longitudinal bore. As described herein, a monolithic extruded part is one having features that are at least partially extruded at the same time. Herein, for example, proximal and distal ends and central baffle walls are simultaneously extruded in baffle preforms and, thereafter are altered (e.g., machined) to fit within an outer can. If a square/rectangular baffle is desirable, for example, the altering of the pre-form can be simply the drilling of the projectile bore and the barrel-accommodating bore and the threading of the proximal end.

Although the invention is illustrated and described herein as embodied in a firearm silencer and methods for manufacturing and fastening a silencer onto a firearm, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale. Further, it is noted that the figures have been created using a computer-aided design computer program. This program at times removes certain structural lines and/or surfaces when switching from a shaded or colored view to a wireframe view. Accordingly, the drawings should be treated as approximations and be used as illustrative of the features of the present invention.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

In this document, the term "longitudinal" should be understood to mean in a direction corresponding to an elongated direction of the silencer or firearm.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to further illustrate various embodiments and to explain various principles and advantages all in accordance with the present invention.

DETAILED DESCRIPTION OF THE INVENTION

Herein various embodiment of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Figure 1:
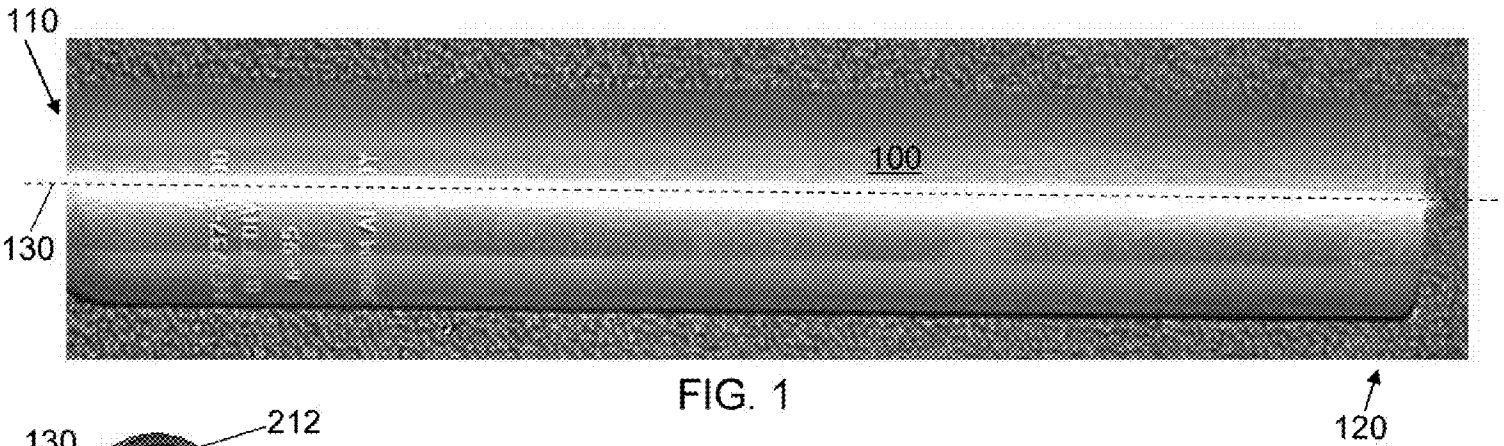
FIG. 1 is a photograph of an exemplary embodiment of an outer suppressor can according to the invention.

Referring now to the figures of the drawings in detail and first, particularly to FIG. 1 thereof, there is shown an exemplary embodiment of a first part of a two part suppressor. This first part is an outer suppressor can 100 that, in its final form, has a cylindrical bottle-type shape with a proximal end 110 entirely open to the environment and a distal end 120 that is closed except for a non-illustrated central distal hole through which the projectile will pass into the environment.

The outer suppressor can 100 is deep drawn or spun as a single part. As such, the outer suppressor can 100 can have a straight wall (parallel to the longitudinal axis of a gun barrel), can be slightly tapered (outward or inward), or can be stepped (outward or inward). The distal end 120 of the outer suppressor can 100 be shaped as needed. It can be, for example, flat or have some other useful shape like an expansion cone, a muzzle brake, and/or a flash hider. In an exemplary embodiment of the outer suppressor can 100, the open proximal end 110 has a larger wall thickness and a single interior thread. One process for forming such a thread is by machining. This interior thread allows the outer suppressor can 100 to be attached removably to an outer thread of the gun or the second part of the inventive silencer. One particular exemplary embodiment, reuses a standard $CO_2$ tank made, for example, by Parker Cliff Division. With such a tank, the open end of the tank is removed to create the open proximal end 110 and the interior thread is created.

An exemplary embodiment of an inner baffle 200, the second of the two suppressor parts, is shown in FIGS. 2 to 8. The inner baffle 200 has a proximal end assembly 210 to be attached removably to a barrel 1010 of the firearm 1000. The suppressor can 100 slides over the inner baffle 200 (in the direction of arrow A in FIG. 2) and attaches thereto at the proximal end assembly 210 near the firearm 1000. Exterior threads (not illustrated) are provided on a proximal boss 212 of the proximal end assembly 210. If a proximal flange 214 is provided at the proximal end of the exterior threads, the flange 214 acts as a stop for the outer suppressor can 100. When attached together, the central axes 130, 230 of both the outer suppressor can 100 and the inner baffle 200 are coaxial with the central axis 1012 of the firearm barrel 1010.

Figure 2:
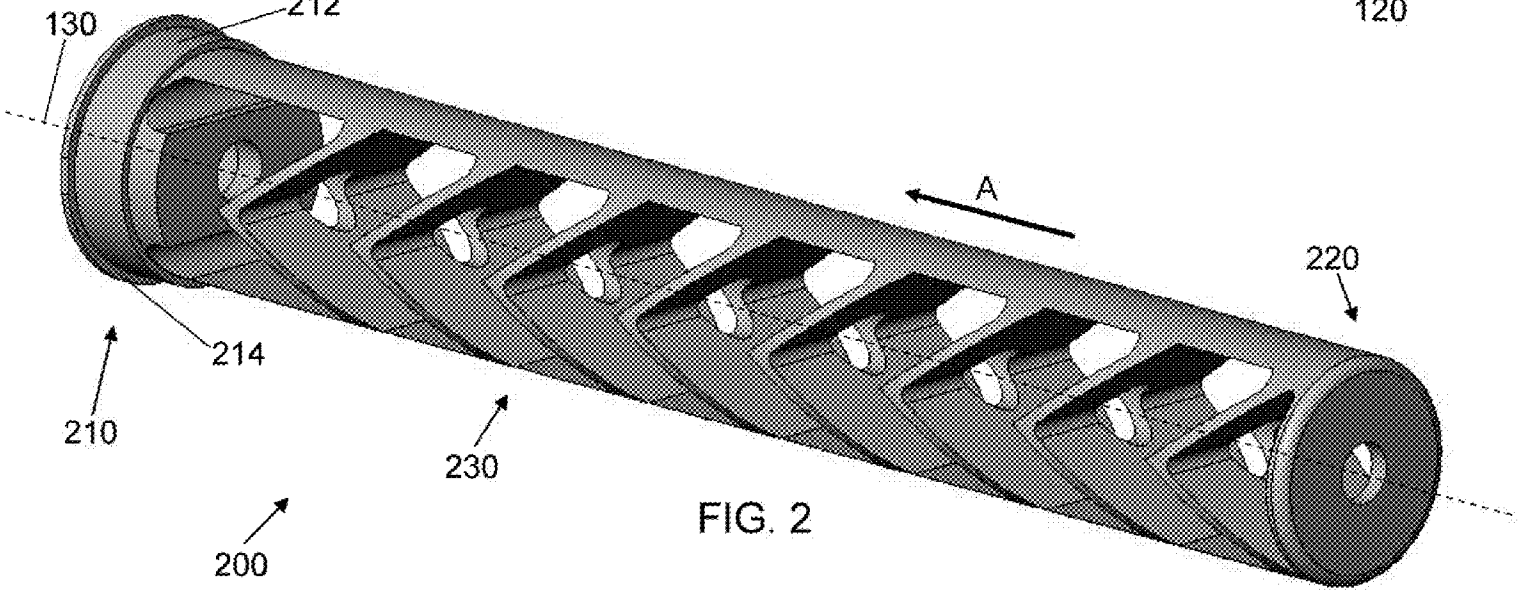
FIG. 2 is a perspective view from the front side of an inner baffle according to the present invention.
Figure 3:
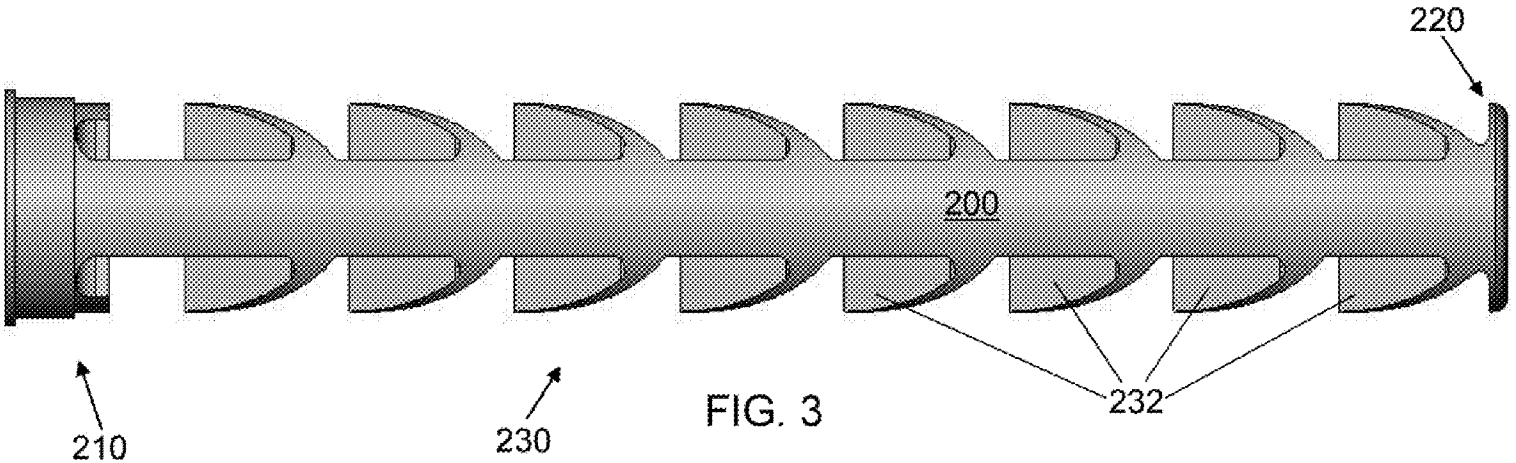
FIG. 3 is a plan view of the baffle of FIG. 2.
Figure 4:
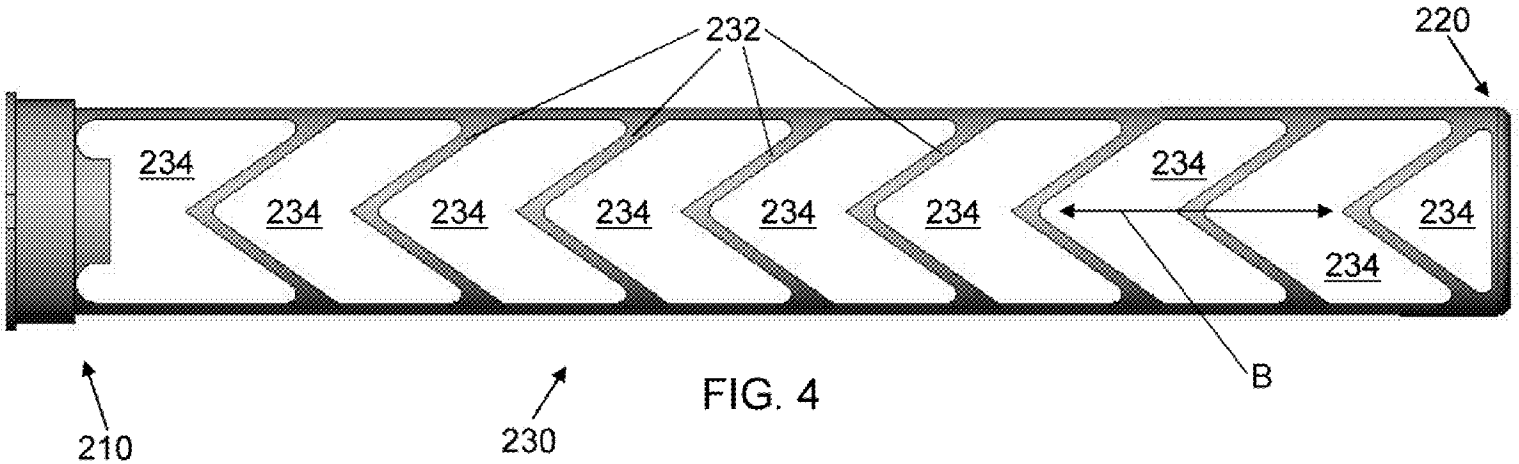
FIG. 4 is a side elevational view of the baffle of FIG. 2.
Figures 5, 6:
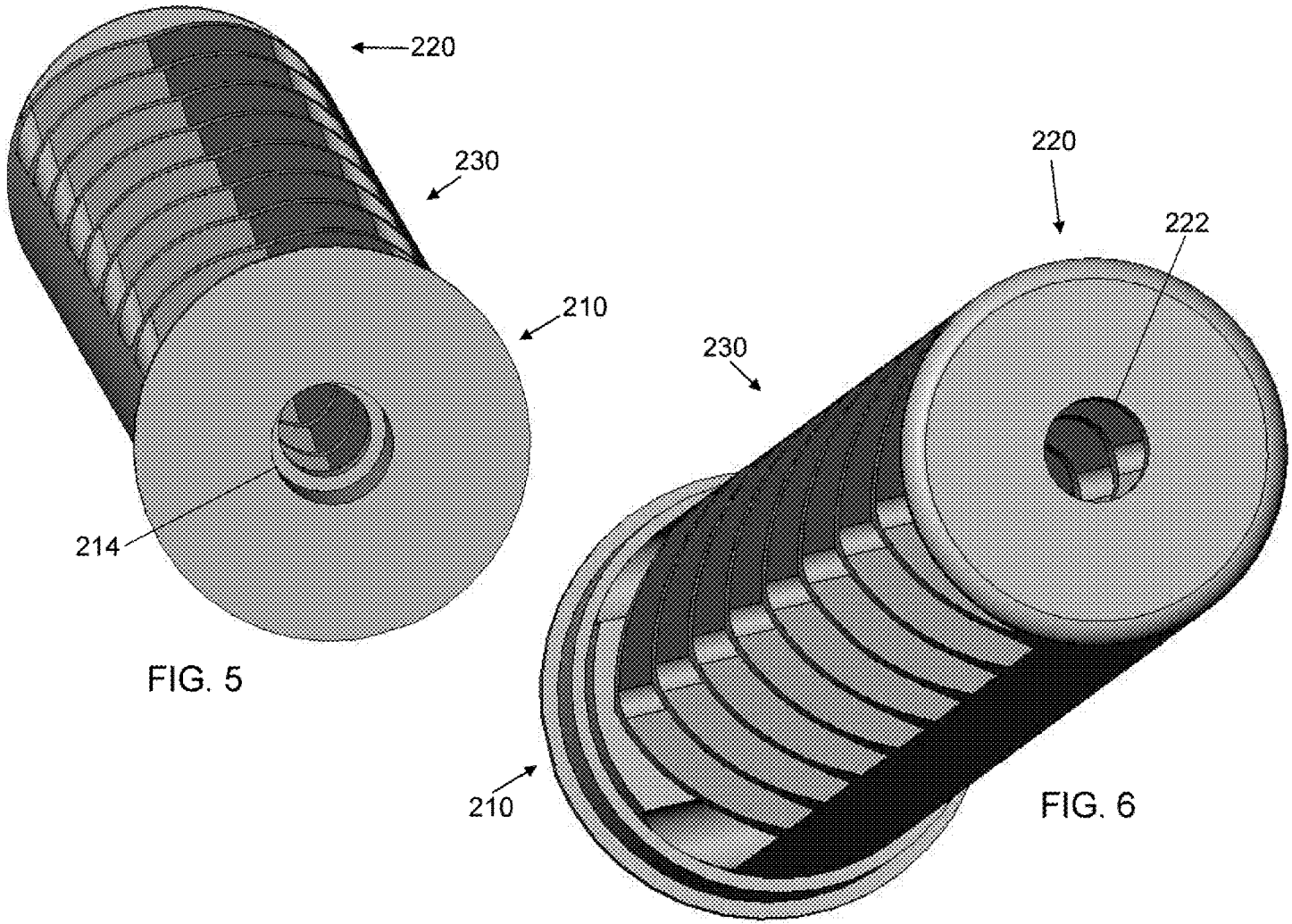
FIG. 5 is a perspective view from the rear side of the baffle of FIG. 2.
FIG. 6 is a perspective view from the front side of the baffle of FIG. 2.

FIGS. 3 through 6 show various orientations of the exemplary embodiment of inner baffle 200 of FIG. 2. The top and side elevational views of the inner baffle 200 of FIGS. 3 and 4 show the central baffle section 230 with a linear longitudinal span. FIGS. 5 and 6, in contrast, show an inwardly tapering longitudinal span starting at the proximal end 210 and continuing to the distal end 220. This taper need not have this particular shape; it can be decreasing along any trajectory and can also be stepped if desired.

Figure 7:
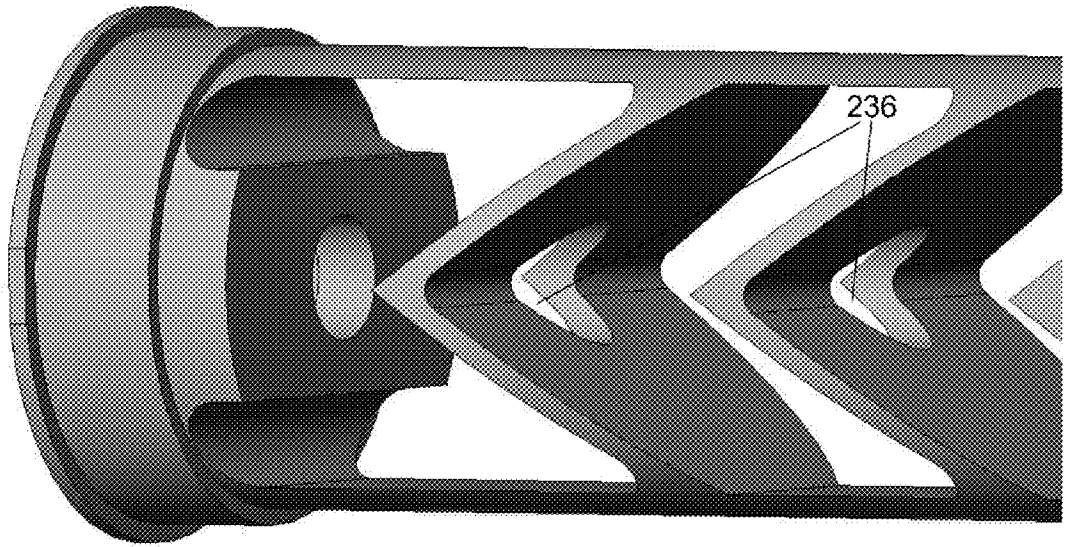
FIG. 7 is an enlarged perspective view of a rear portion of the baffle of FIG. 2 from a front side thereof.
Figure 8:
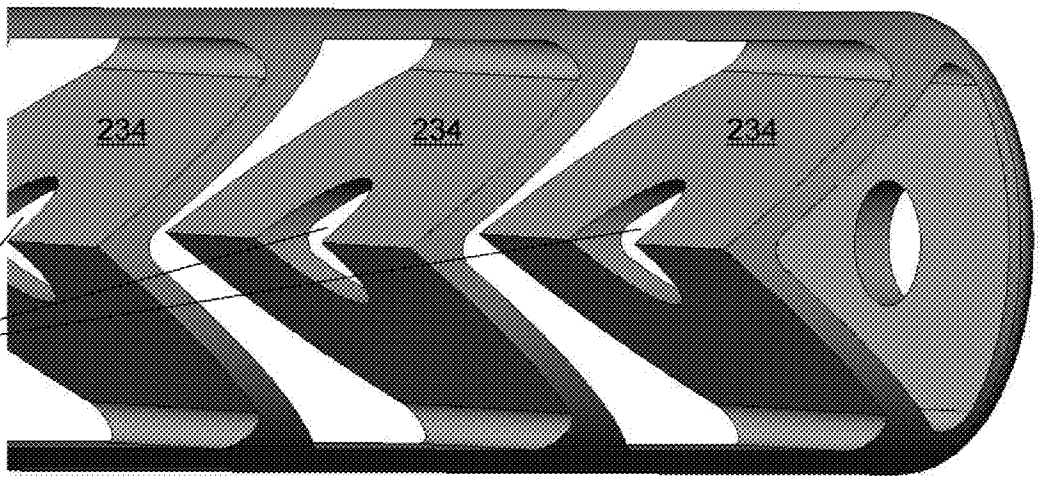
FIG. 8 is an enlarged perspective view of a front portion of the baffle of FIG. 2 from a rear side thereof.

The distal end 220 of the inner baffle 200 defines a distal throughbore 222 that is coaxial with the central distal hole of the outer suppressor can 100 when the two parts are connected together. The proximal end 210 of the inner baffle 200 similarly defines a proximal throughbore 214 that is coaxial with the central distal hole of the outer suppressor can 100 when the two parts are connected together. In the exemplary embodiment shown in FIG. 5, the proximal throughbore 214 is sufficiently large enough to permit passage of at least a portion of the firearm barrel. This portion appears as a stepped throughbore in FIG. 5. FIGS. 7 and 8 are enlarged portions of the proximal and distal ends of the inner baffle, respectively.

The extruded inner baffle 200 (the extruded manufacturing process will be explained in further detail below) defines a number of baffle chamber walls 232 between the two ends 210, 220 of the baffle 200. These baffle chamber walls 232 extend substantially in the transverse (left-right) direction to, thereby, define a number of baffle chambers 234 within the inner baffle 200. As shown in FIGS. 7 and 8, each of the baffle chamber walls 234 has a central throughbore 236 that is axially aligned with the central distal hole of the suppressor can 100, the barrel axis 1012 of the firearm 1000, and the central throughbores 222, 214 of the baffle's distal and proximal ends 220, 210 when all are connected together. In this way, a central coaxial projectile path 130-230-1012 is defined by all of the distal, proximal, and central throughbores 214, 222, 236 of the inner baffle 200, the central distal hole of the suppressor can 100, and the barrel 1010 of the firearm 1000.

Figure 9:
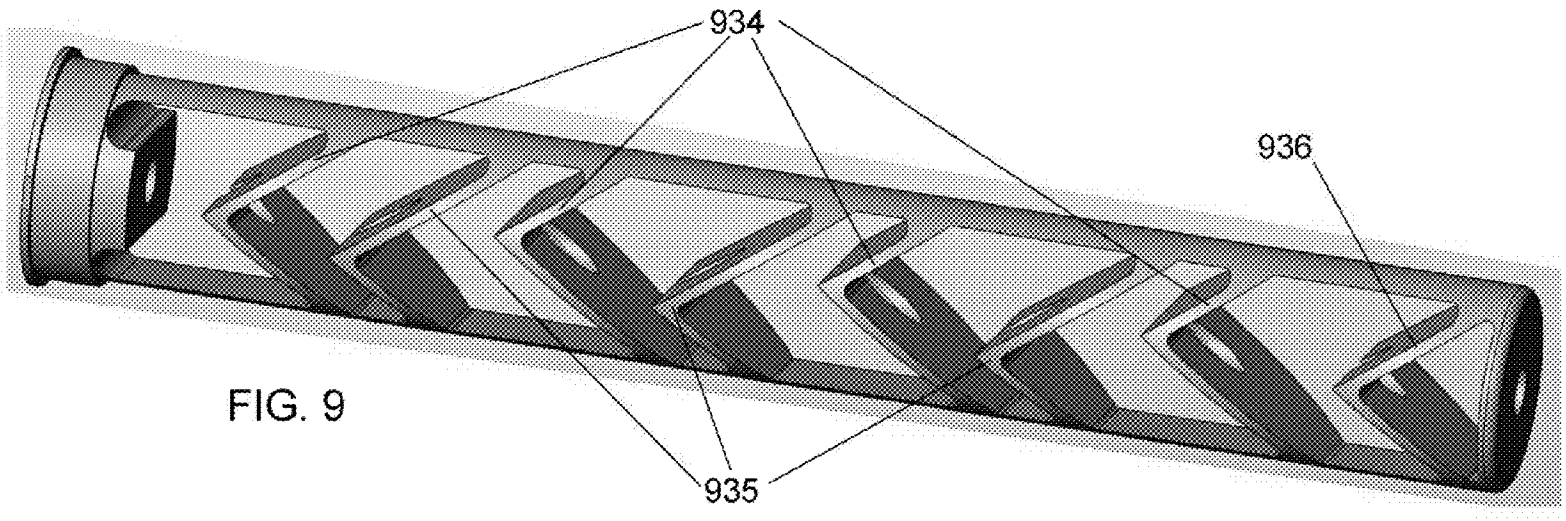
FIG. 9 is a perspective side view of an alternative embodiment of the inner baffle according to the invention.

The baffle chamber walls 232 of FIGS. 2 through 8 are all relatively symmetrical, as shown especially well in FIG. 4. This pattern form baffle chambers 234 with substantially similar volumetric areas and shapes (except for the distal-most and proximal-most chambers 234). Due to the nature of extrusion manufacturing, this pattern can be varied in any number of ways. In fact, each baffle chamber wall 232 can have its own unique shape, if desired. One alternative configuration is illustrated in FIG. 9. In this example, every second baffle chamber wall 934, 935 is the same (the distal-most wall 936 is different from both other walls 934, 935).

Figure 10:
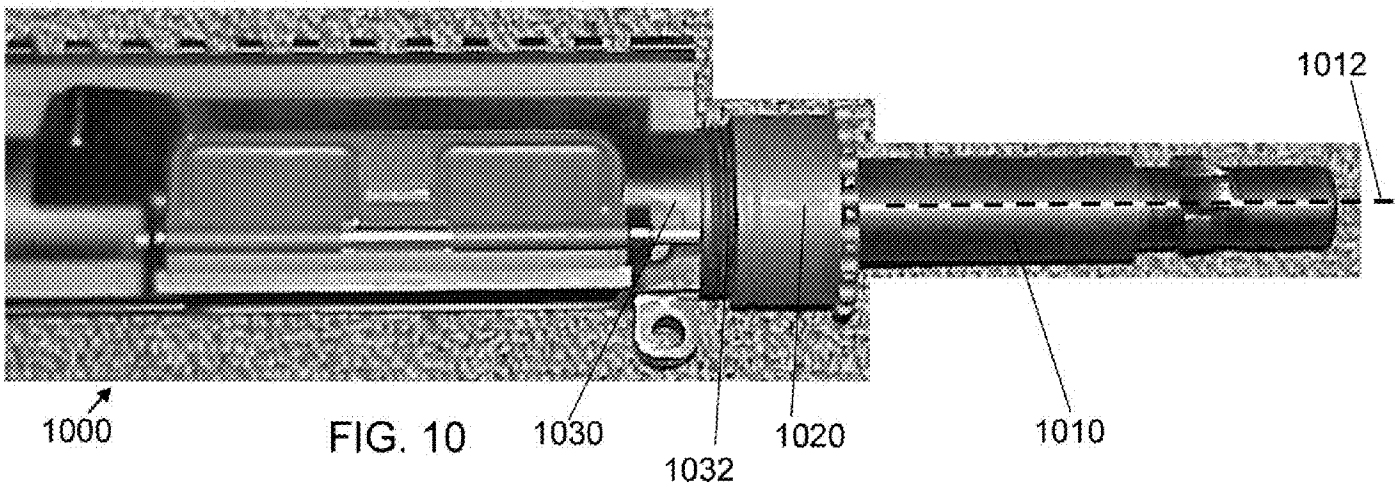
FIG. 10 is a photograph of a fragmentary distal portion of a firearm with a barrel nut.

FIG. 10 shows an exemplary embodiment of a rifle 1000 to which the suppressor of the present invention is to be attached. A barrel nut 1020 of the firearm 1000 has non-illustrated internal threads on its proximal end and a non-illustrated throughbore for receiving therethrough the barrel 1010. For securing the barrel 1010 to the firearm 1000, the barrel nut 1020 is slid onto the distal end of the barrel 1010 towards the upper receiver 1030. The upper receiver 1030 has exterior threads 1032 to removably mate with the internal threads of the barrel nut 1020. When threaded thereon, the barrel nut 1020 secures the barrel 1010 to the upper receiver 1030 and, at the same time, aligns the barrel 1010 within the throughbore so that the proximal end of the barrel 1010 is aligned with projectiles to be shot.

Figure 11:
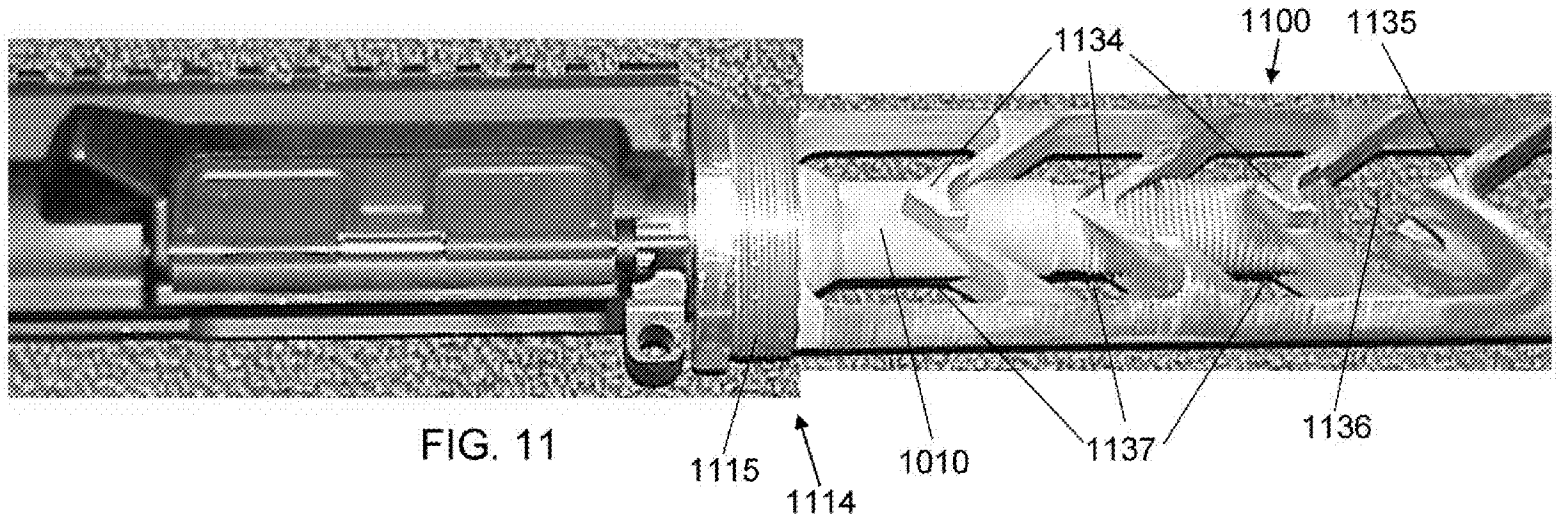
FIG. 11 is a photograph of a fragmentary distal portion of the firearm of FIG. 10 with an exemplary embodiment of an inner baffle according to the present invention attached to and acting as a barrel nut.

The exemplary embodiment of the inner baffle 1100 of FIG. 11 is formed as an integral configuration, in which a distal portion of the barrel 1010 is internal to the silencer. As can be seen herein, the proximal boss 1114 of the inner baffle 1100 has external threads 1115 for receiving thereon the proximal end 110 of the outer suppressor can 100. Also shown in this embodiment are three distal baffle chamber walls 1134 having internal throughbores shaped to fit the distal end of the barrel 1010. These throughbores are larger than the throughbores of the remaining baffle chamber walls 1135 because only the projectile needs to travel therethrough. These three distal baffle chamber walls 1134 are also different in shape from those described herebefore. In particular, these walls 1134 have different widths and shapes to create what is referred to as a "blow back" configuration. The barrel 1010 ends in the fourth baffle chamber 1136. If the walls 1134 were not cut out on the sides of the barrel 1010 in some way, then the gases would not be able to travel in or to the first three baffle chambers 1137. By removing side portions of these walls 1134, the gases can expand and move into and out of the three proximal baffle chambers 1137.

Figure 12:
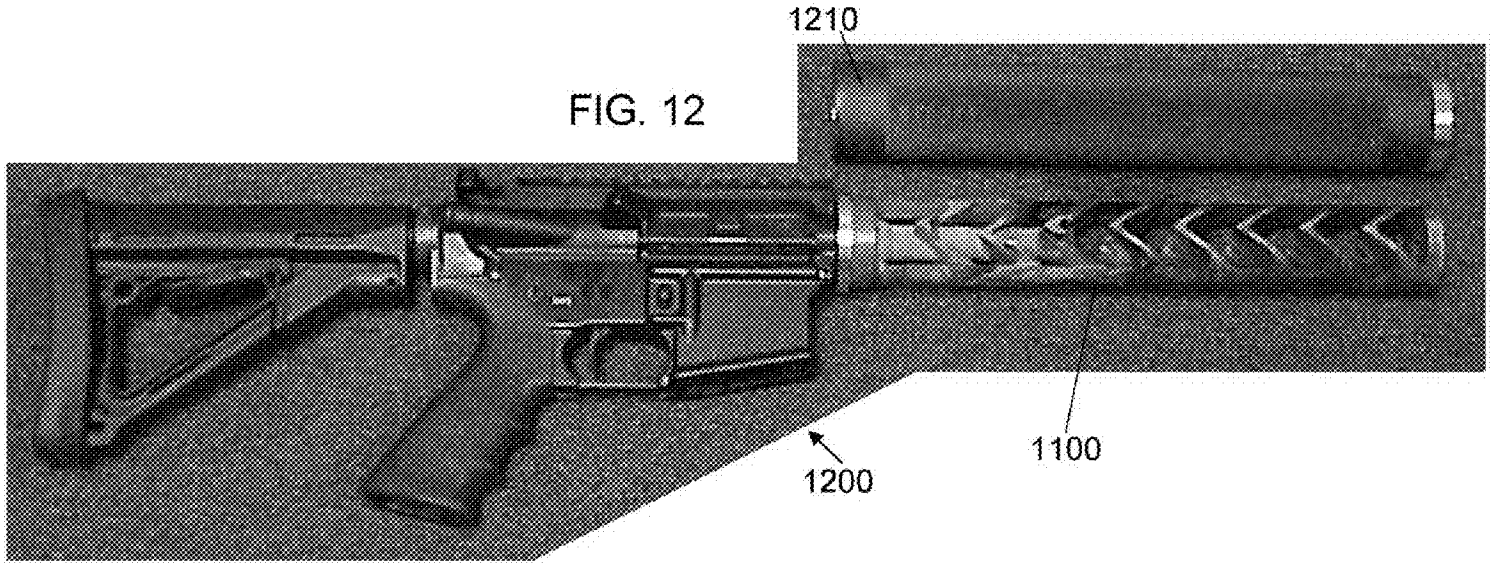
FIG. 12 is a photograph of the inner baffle of FIG. 11 on the firearm and an exemplary embodiment of an outer suppressor can according to the invention.

FIG. 12 shows a firearm 1200 with the inner baffle 1100 mounted thereto. For clarity, the outer suppressor can 1210 is shown adjacent the inner baffle 1100 in a position laterally offset from the projectile travel axis. To assemble the parts, the outer suppressor can 1210 is slid over the inner baffle 1100 towards the firearm 1500 and screwed onto the inner baffle 1100.

Figure 30:
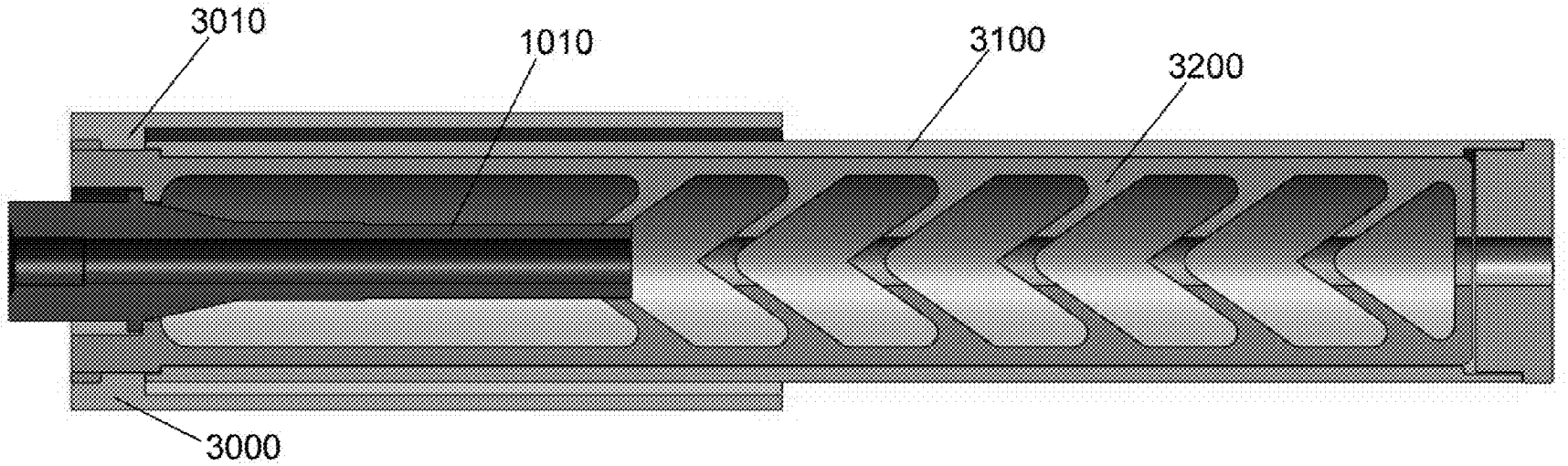
FIG. 30 is a longitudinal cross-sectional view of an alternative embodiment of a suppressor according to the invention with a heat shield.

What is referred to in the art as an outer heat shield typically surrounds the portion of the barrel extending out of the upper receiver. Here, the suppressor surrounds the barrel end. Nonetheless, if desired, a heat shield 3000 (shown in FIG. 30) can be shaped to surround the outer suppressor can 100. This heat shield 3000 can be easily and quickly attached to the firearm 1500 by having a proximal opening 3010 with a diameter greater than the outer diameter of the external threads 1115 but less than the outer diameter of the flange 1116. In this way, the act of connecting the outer suppressor can 3100 to the inner baffle 3200 would secure the heat shield firmly to the firearm. The hand guard can include a Picatinny rail system, for example, if desired.

Extrusions are formed by creating a long sheet having a three-dimensional shape in the direction of extrusion. For example, a rectangular box with interior trusses can be extruded in an extrusion direction. This box can be cut in the direction orthogonal to the extrusion direction to create multiple identical extruded parts. This process is used to form the inner baffle of the present invention.

Figure 13:
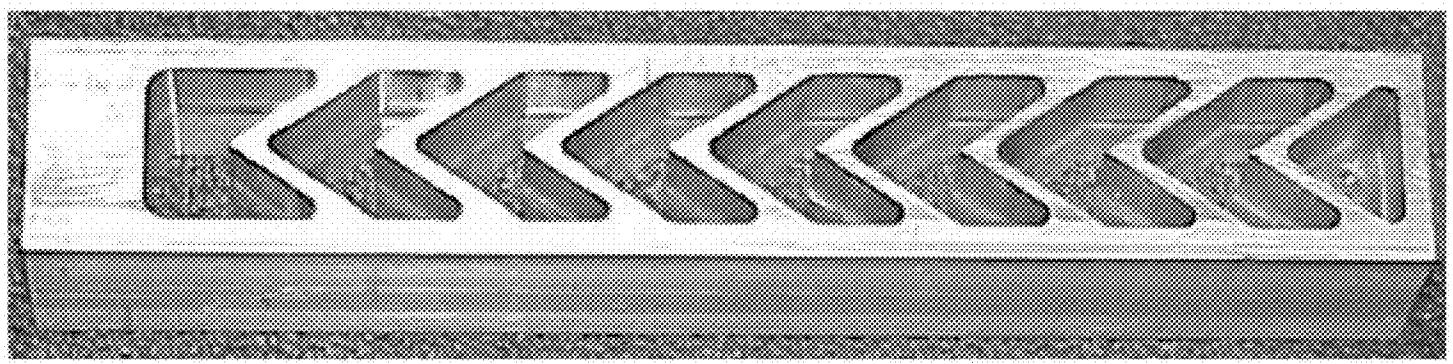
FIG. 13 is a photograph of an exemplary embodiment of an inner baffle pre-form according to the invention (the photographs of FIGS. 11 to 13 illustrate a BATF Form 1-approved prototype silencer submitted on Dec. 14, 2007 and approved on Jan. 28, 2008)
Figure 14:
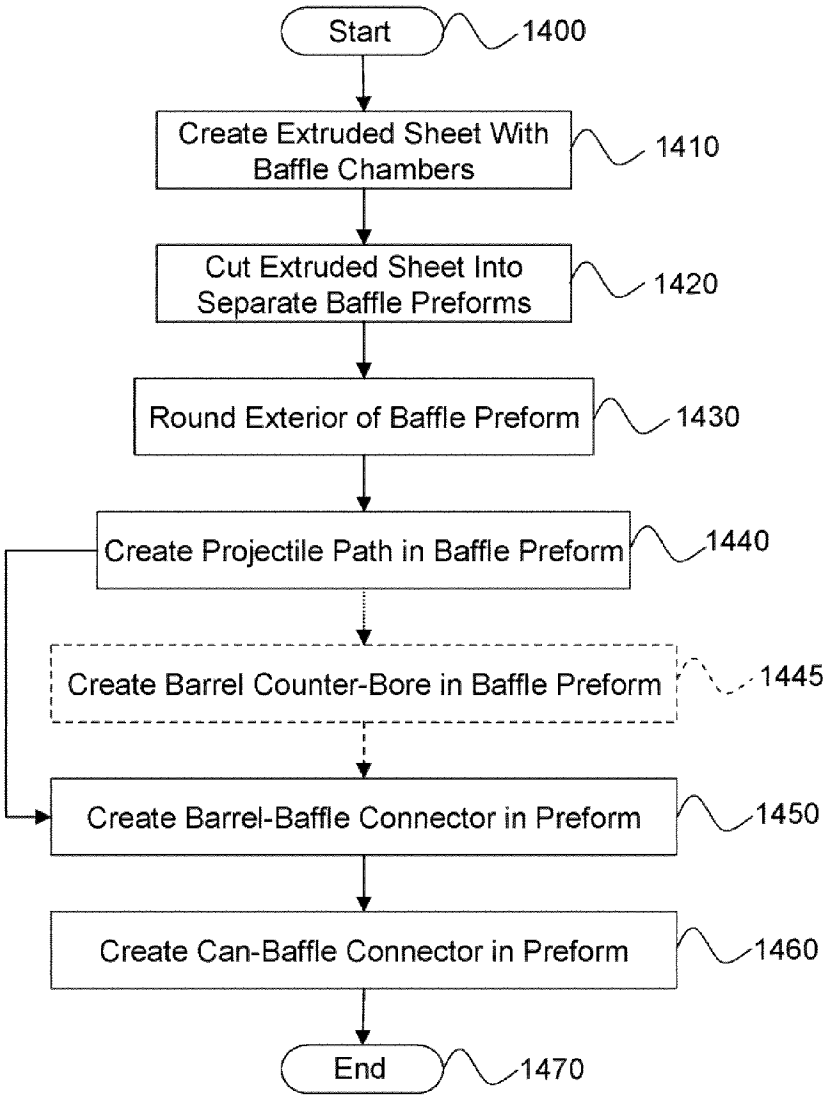
FIG. 14 is a flow chart for creating a suppressor according to the present invention.

More particularly, the extrusion die is shaped to create a rectangular box having baffle chambers therein. An example of such an extrusion is shown in FIG. 13. A long sheet of these extrusions are cut to the desired width for use as an inner baffle. For example, one single 10-foot long extrusion, for example, can create sixty (60) 2-inch wide inner baffle pre-forms, like the one shown in FIG. 13. So configured, each of these baffle pre-forms has most of the machining already complete. In comparison to the prior art where an entirety of a bar stock used to create an inner baffle is machined, the only operations needed to finalize the inventive rectangular pre-form inner baffle are set forth with regard to the flow chart of FIG. 14.

The process starts at step 1400. In Step 1410, an extrusion sheet having the baffle chamber cutouts is created. Separate inner baffle performs are cut from the extruded sheet in Step 1420. Each inner baffle perform, for example, the pre-form shown in FIG. 13, is turned to round the outside surface to a point where the exterior circular diameter is sufficient to fit inside the housing of the inventive suppressor can in Step 1430. In Step 1440, a longitudinal projectile hole is created (e.g., drilled) through the baffle perform. This hole has a diameter sufficient to allow for projectile clearance. Where the suppressor is an integral-type suppressor, in Step 1445, a counter-bore is created at the proximal end of the turned column with a diameter sufficient to fit a firearm barrel therein. For attaching the inner baffle to the firearm, in step 1450, a connector (e.g., an interior thread) is created at an inside portion of the proximal baffle adapter area (which is at the counter bore for integral-type suppressors). For securing the outer suppressor can to the baffle adapter and, thereby, to the firearm, in Step 1460, a connected is created (e.g., an external thread) on an outside portion of the proximal baffle adapter area. It is noted that all of these operations can be performed on a CNC lathe with a single setup operation. The suppressor is finished and the process stops in Step 1470.

Figure 15:
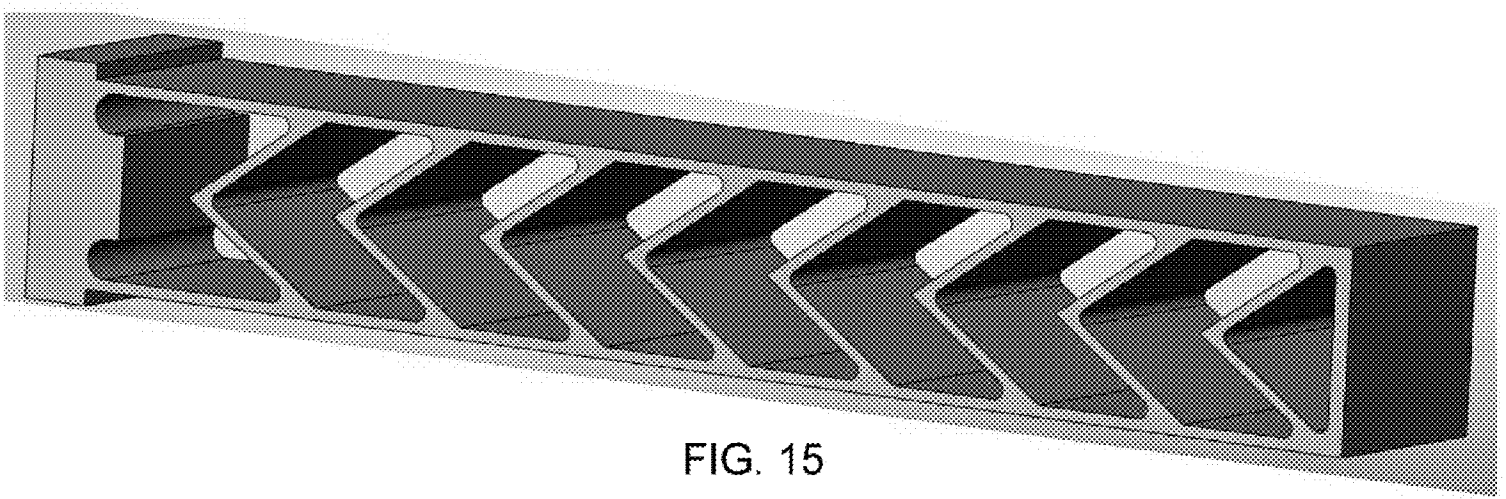
FIG. 15 is a perspective view from the side of an exemplary embodiment of another baffle pre-form according to the invention.

The inventive suppressor configuration allows for easy and simple disassembly to clean and/or repair the suppressor as needed or desired. The illustration in FIG. 15 is an alternative embodiment to the pre-form of FIG. 13. In this embodiment, the upper and lower baffle surfaces are smaller in distance from the center extrusion plane than the upper and lower surfaces of the proximal baffle adapter.

Figure 16:
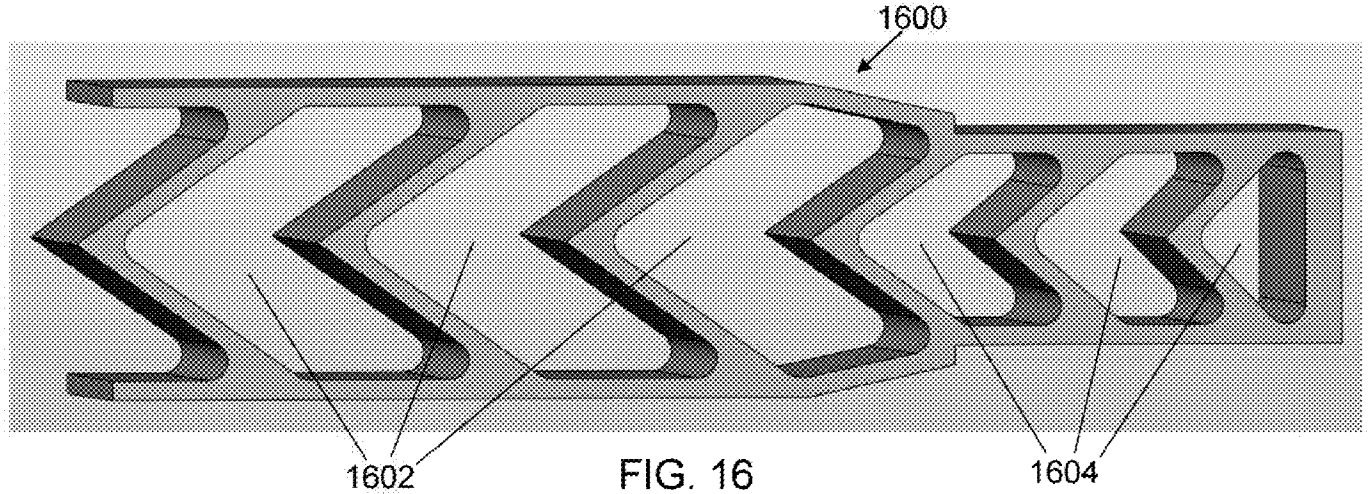
FIG. 16 is a perspective view from the side of another alternative embodiment of a baffle pre-form according to the invention.

One characteristic of suppressor efficiency is the total volume of the baffle chambers. With larger baffle chamber volume, acoustic suppression increases. In the inner baffle extrusions illustrated in the embodiments above, the baffle chambers have relatively similar transverse extents. The inventive suppressor, however, is not limited to such inner baffle configurations. As illustrated in FIG. 16, for example, an alternative exemplary embodiment to the pre-form of FIG. 13 is shown as an enlarged inner baffle 1600 having proximal baffle chambers 1604 larger than distal baffle chambers 1636. This embodiment of the inner baffle 1600 has a proximal portion 1602 that tapers inward so that the distal baffle chambers 1636 are smaller than the proximal baffle chambers 1604.

Figure 17:
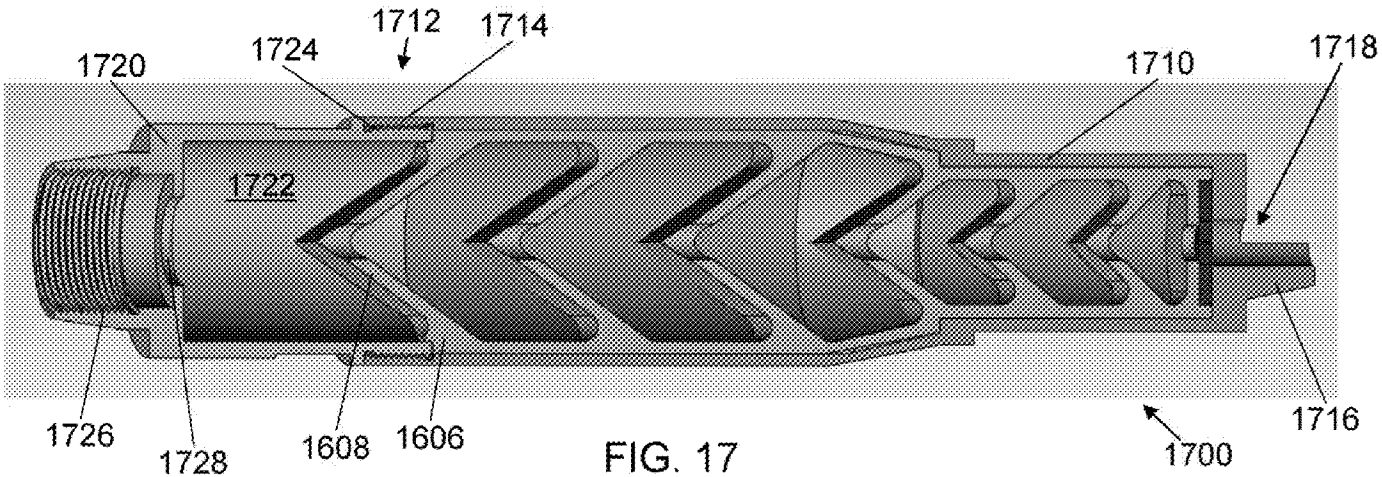
FIG. 17 is a longitudinal cross-sectional view of a finished version of the baffle pre-form of FIG. 16 within a two-part outer housing according to the invention.

In its final shape, the expanded inner baffle 1600 is surrounded by a two-part outer suppressor can 1700 having a distal outlet can part 1710 and a proximal connection can part 1720. In the exemplary embodiment of FIG. 17, the distal outlet can part 1710 surrounds the inner baffle 1602 and defines all of the baffle chambers 1602, 1604 except for the proximal-most baffle chamber 1722. The proximal connection can part 1710 is connected to the proximal end 1712 of the distal outlet can part 1710 in any sufficient connection configuration. FIG. 17 illustrates a screw-type connection 1712 in which outer threads of an inner distal flange 1724 of the proximal connection can part 1720 screw into inner threads of a proximal bore 1714 of the distal outlet can part 1710. The connection 1714-1724 and the proximal end 1606 are shaped to secure the inner baffle 1600 inside the suppressor can 1700 when the distal outlet can part 1710 and the proximal connection can part 1720 are connected securely together.

Like the proximal ends of the inner baffles described above, the can 1700 is attached to the firearm at the barrel nut attachment location which has outer threads. These threads securely connect to inner proximal threads 1726 of the proximal connection can part 1720. Like the embodiments above, the inner throughbore 1728 for receiving the barrel therein can be only at the central portion of the proximal connection can part 1720 or can extend through one or more of the proximal-most baffle chamber walls. In the embodiment shown in FIG. 17, the proximal-most baffle chamber wall 1608 is not expanded to house a distal tip of a barrel and, therefore, the barrel ends between this chamber wall 1608 and the inner throughbore 1728.

It is known that firearms, especially semi-automatic and automatic firearms, have a tendency to lift the distal end of the barrel when firing. Various muzzle devices exist that can be used to deflect the expanding gases upwards to, thereby, impart a downwardly directed force to the distal end of the firearm. Such force can be used to "balance" the firearm and minimize or counteract such muzzle lift. To compensate for this lift, the distal outlet can part 1710 has, at its distal end, a muzzle brake. In particular, a muzzle flange 1716 having a semi-circular bottom trough is placed below the exit opening 1718 of the distal outlet can part 1710. In such a configuration, expanding outlet gases are directly substantially in the upper hemisphere after exiting out of the exit opening 1718. In this way, the upwards travel of the expanding gases forces the barrel tip downward. Of course, the muzzle flange 1716 can take any other shape that deflects the gases upwards.

Prior art firearm suppressors are axially symmetrical and have central axes that coincide with the central barrel axis (which substantially coincides with the projectile trajectory axis). This means that, for suppressors having a diameter greater than a barrel diameter, at least a portion of the suppressor exists above the top of the barrel. Most firearm sights also exist at the top side of the barrel. As such, typical suppressors, if large enough, can block the sights, rendering them useless. An additional benefit of the monolithic baffle of the present invention (over a stacked-cone-style prior art baffle) is the ability to have the projectile bore offset from the axis of the can and the inner baffle.

Figure 18:
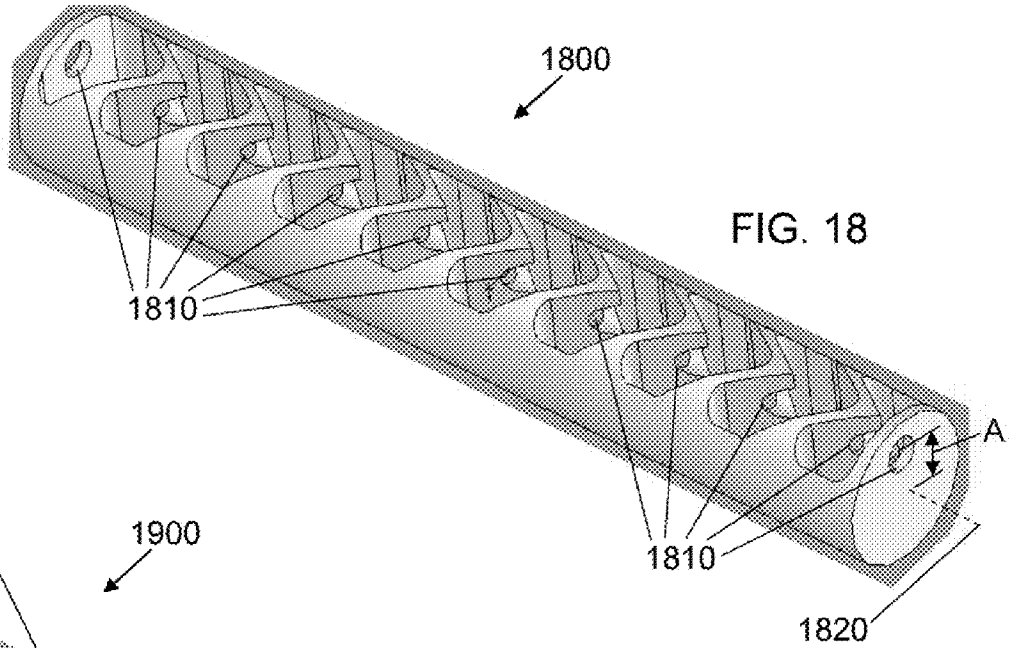
FIG. 18 is a perspective view from the side of yet another exemplary embodiment of an inner baffle according to the invention.

FIG. 18 illustrates an offset inner baffle 1800 having an offset bore 1810. The center axis of the bore 1810 is offset at a distance "A" from the central axis 1820 of the offset inner baffle 1800. This radial distance "A" can be any amount up to the point where the bore 1810 contacts the outer circumference of the offset inner baffle 1800. In such a configuration, the outer suppressor can 100 would form at least a small portion of the bore 1810. This placement may be needed to lower the height of the silencer can 100 for either aesthetics reasons or, more importantly, to prevent the blockage of the gun's original iron sights. Additionally, this offset bore 1810 could allow for a reservoir of liquid to aid in cooling the hot gases without interfering with the bullet trajectory while travelling through the bore 1810. A small amount of liquid, such as water, can be place in the silencer and due to the shape of the baffle, gravity will keep it away from the bore. See, for example, FIG. 20.

The offset inner baffle 1800 of the present invention can be manufactured easily because it is a monolithic block and all the baffles are permanently fixed. A common bore 1810 is drilled offset from the axis 1820 to lower the silencer 100, 1800 relative to the gun barrel. Such an offset bore 1810 is extremely difficult to machine for a prior art cone-type baffle. Further, all the baffles in a cone-type configuration would need to be permanently fixed in position relative to one another and to the barrel—a difficult (and, therefore, expensive) manufacturing task.

Figure 19:
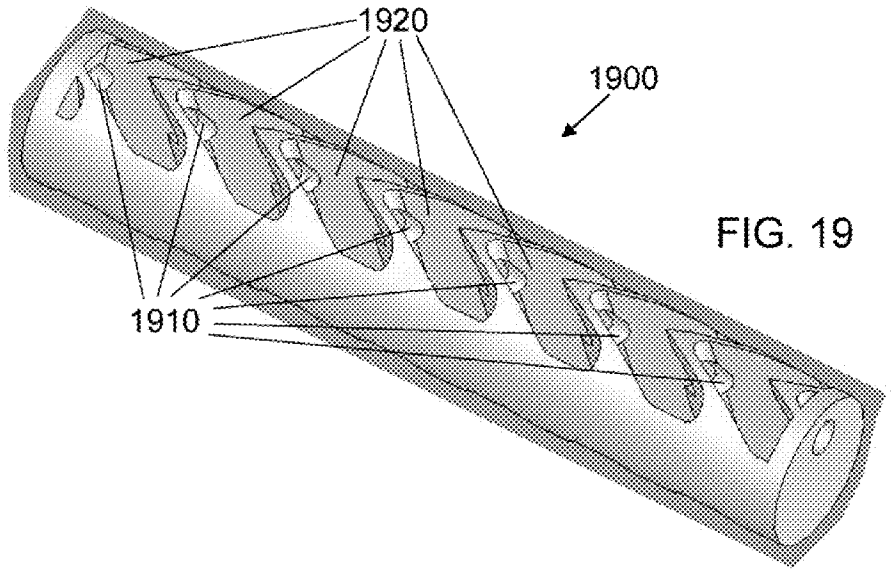
FIG. 19 is a perspective view from the side of still another exemplary embodiment of an inner baffle according to the invention.

The extrusion of the present invention is defined to have an extrusion plane extending in an extrusion direction and, orthogonally, to the right and left of the extrusion. With respect to FIG. 4, for example, the extrusion plane extends into and out from the drawing plane at a 90-degree angle from the FIG. 4 drawing plane and bisects the baffle 230 along line B. The exemplary baffles described above have been formed by first cutting the individual baffle pre-forms in a plane orthogonal to the extrusion plane, i.e., in a plane parallel to the plane of the drawing of FIG. 4, for example. However, the present invention is not limited to such pre-form cutting. In particular, the pre-form separation cuts can be made in a cutting plane that is at an angle to the plane of the drawing of FIG. 4. Such cuts provide asymmetric baffle chambers. One of a number of possible asymmetric inner baffles 1900 is shown in FIG. 19. In this particular embodiment with a chevron configuration, the bore 1910 is not centered within the chevron pattern of the baffle chamber walls 1920. Rather, each baffle wall 1920 extends from above and behind the respective borehole 1910 to below and forward of that borehole 1910. Thus, the gas is not simply split in half horizontally—upper and lower—as in the exemplary embodiment of FIGS. 2 to 8. Instead, the gas is both split in half vertically and projected downward into the far distal end of each baffle chamber as it hits each baffle chamber wall 1920.

Figure 20:
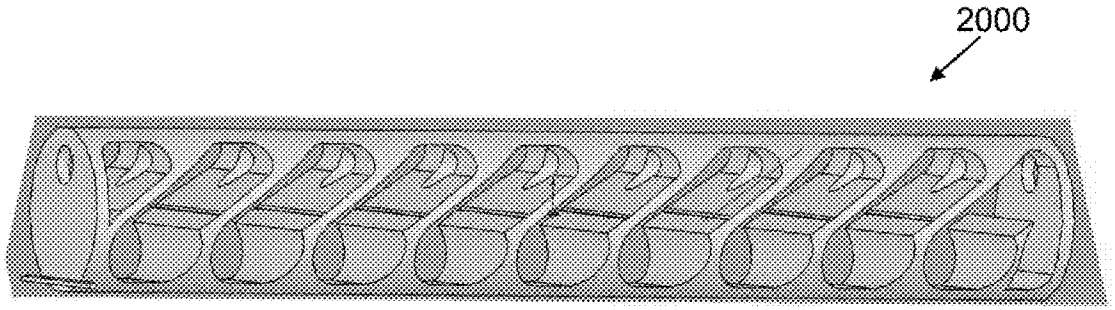
FIG. 20 is a perspective view from the side of a further exemplary embodiment of an inner baffle according to the invention.
Figure 21:
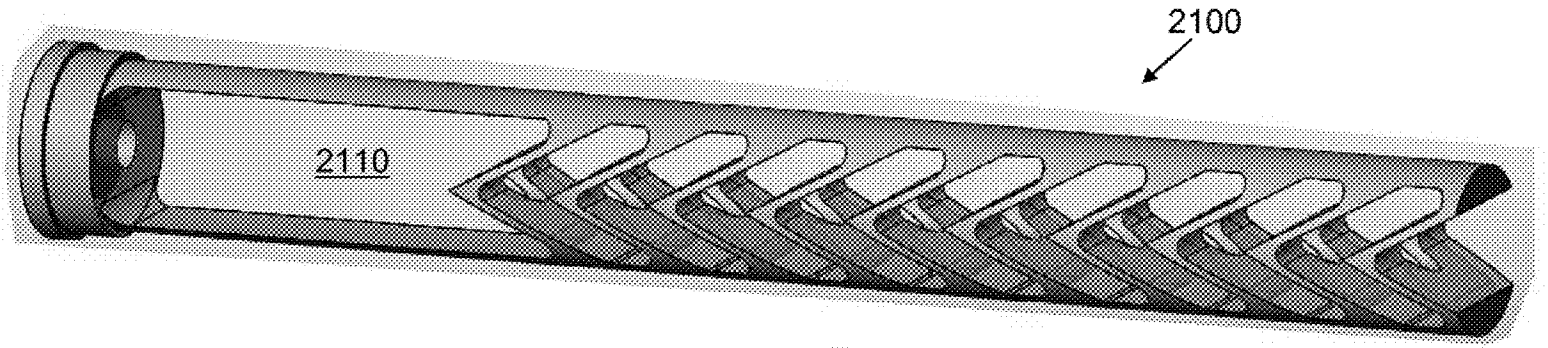
FIG. 21 is a perspective view from the side of another exemplary embodiment of an inner baffle according to the invention.

As indicated above, again, the extrusion patterns of the baffle chamber walls are not limited to the chevron pattern. Staggered, offset, swirling, redirection, partial stage vent, and skiving gas patterns can also be extruded. Some exemplary alternative extrusion shapes are illustrated in FIGS. 20 and 21. The inner baffle 2100 of FIG. 21 possesses a relatively larger first baffle chamber 2110. In such a configuration, most of the expanding gases from the firing remain in this first baffle chamber 2110, resulting in an improved suppression performance. This feature is taken advantage of in the rifle suppressor embodiments of FIGS. 22 and 23.

Typical rifles (such as an AR-15 or M-16-type rifles, for example) include a barrel 2210, a gas block 2220, and a gas tube 2230. The barrel 2210 is held to the rifle body (not illustrated but see FIG. 12, for example) with a non-illustrated barrel nut that captures the proximal end of the barrel 2210 at an annular proximal flange 2312 shown in the cross-section of FIG. 23. When screwed onto the distal outer threads of the rifle body, the barrel nut presses the proximal flange 2312 rearward and, thereby, secures the barrel 2210 to the rifle body.

Traditionally, silencers screw on to the end of a gun barrel (i.e., non-integral silencers). If the proximal-most baffle chamber is desired to be very large, then the silencer designer has two options—either expand the silencer radially outward or lengthen it distally. Both of these options have disadvantages. As set forth above, if the silencer expands radially, then the firearm sights will be blocked. If the silencer extends distally from the barrel, then the firearm becomes further imbalanced—with the additional weight being added to the extreme distal end of the firearm. The inventive rifle silencer of the invention takes advantage of the space entirely surrounding the barrel 2210 to create a relatively large first baffle chamber 2340 that maximizes the internal volume of the silencer and almost doubles the internal volume of the silencer. By doubling the volume of the silencer, the total gas pressure ejected from the barrel 2210 is lowered significantly. But, the silencer neither increases the radius of the can nor lengthens the can in the distal direction.

Figure 22:
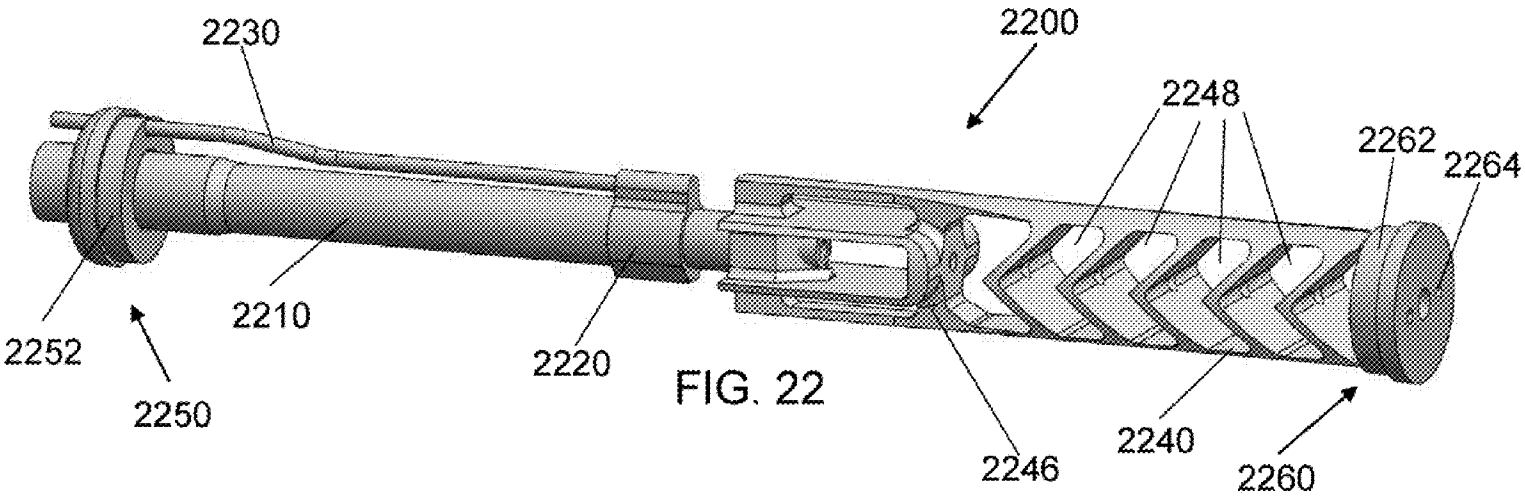
FIG. 22 is a perspective view from the side of an exemplary embodiment of an integral rifle suppressor assembly according to the invention with the outer can removed.
Figure 23:
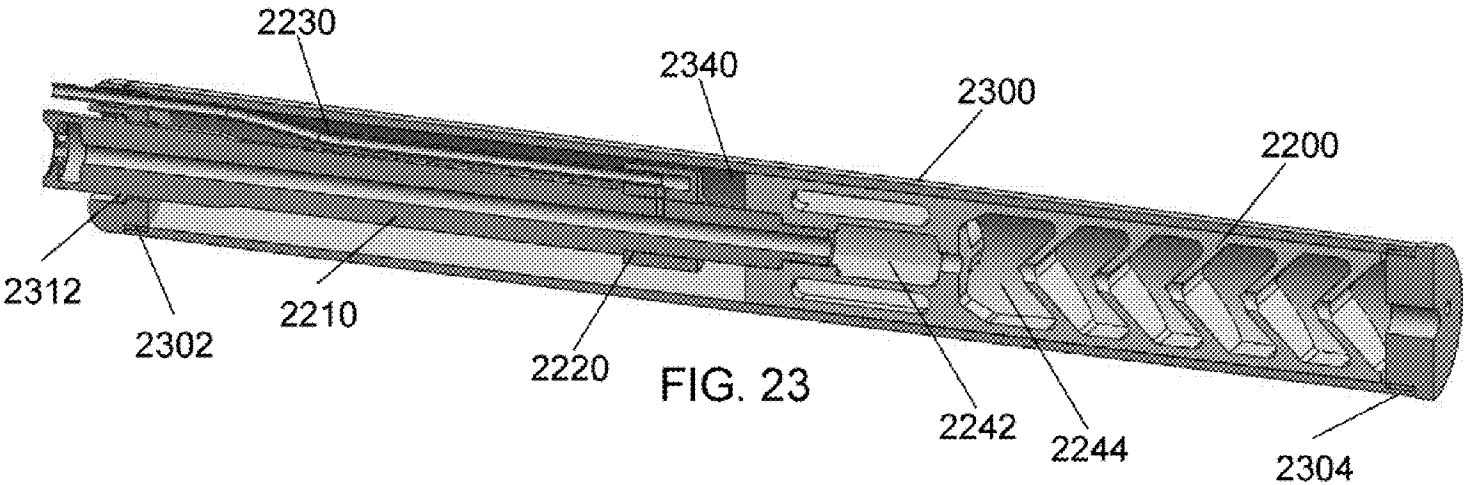
FIG. 23 is a longitudinal cross-sectional view of the rifle suppressor of FIG. 22.
Figure 24:
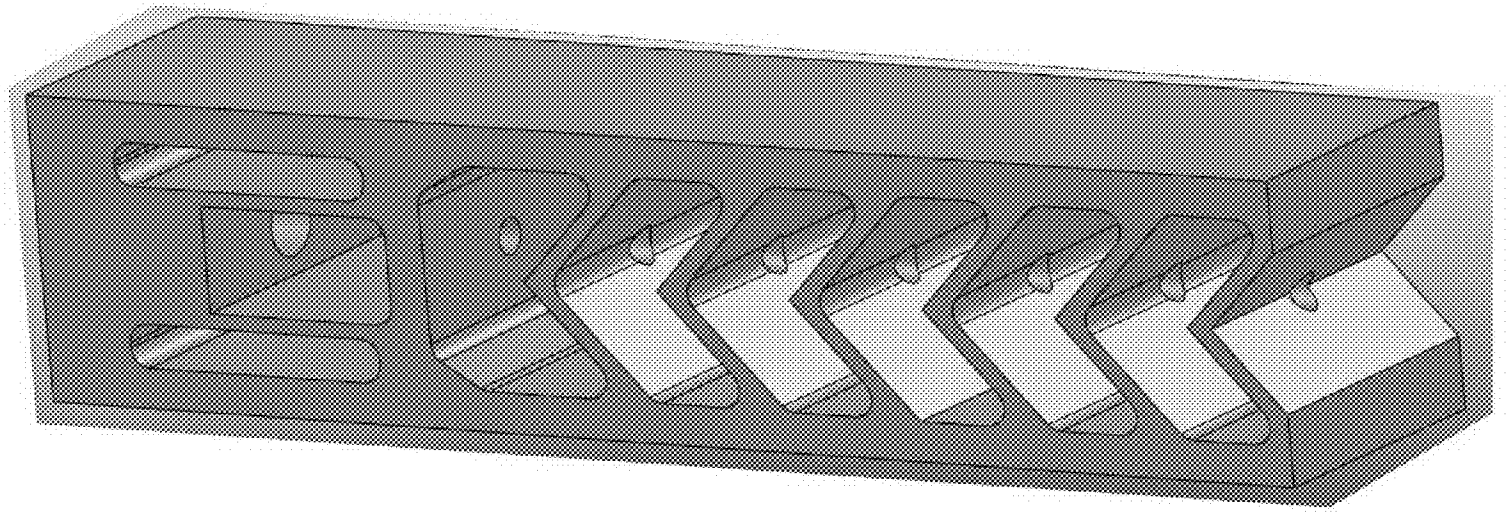
FIG. 24 is a perspective view from the side of a baffle pre-form of the rifle suppressor of FIG. 22.
Figure 25:
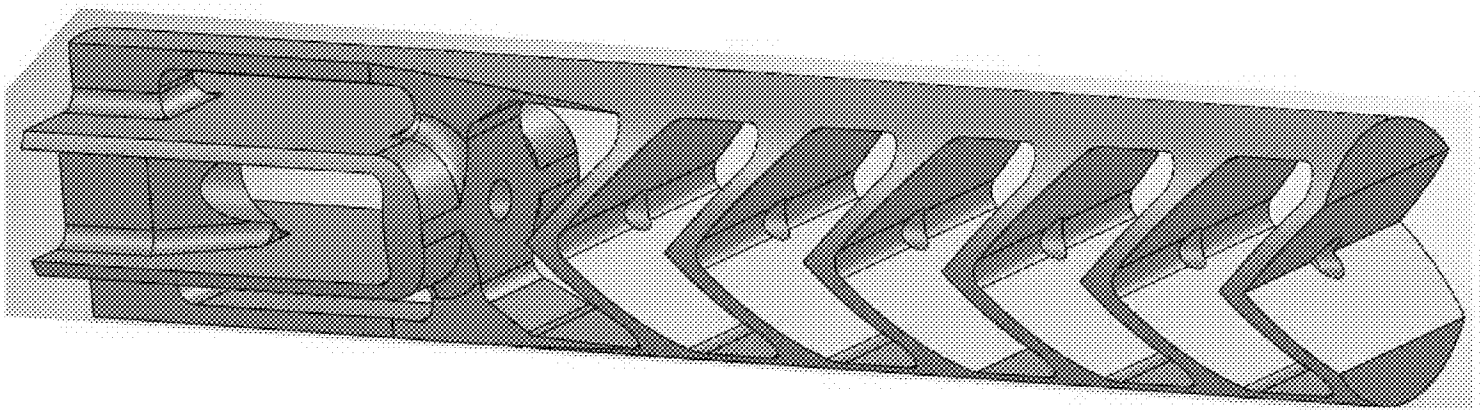
FIG. 25 is an enlarged perspective view from the side of the inner baffle of the rifle suppressor of FIG. 22.

More specifically, FIGS. 22 and 23 show the inventive silencer 2200 including a baffle 2240, a proximal end cap 2250, a distal end cap 2260, and an outer can 2300. Here, the barrel 2210 is incorporated into and fixedly connected to (or integral with) the silencer baffle 2240. A modified barrel nut forms the proximal end cap 2240. The proximal end cap 2250 has an inner boss 2252 that fits snugly within the proximal end opening 2302 of the outer can 2300. Connection of the proximal end opening 2302 to the inner boss 2252 can occur in a variety of ways, by an adhesive, by a weld, by a press-fit, to name a few. Like the proximal end cap 2240, the distal end cap 2260 is secured to the distal end opening 2304 of the outer can 2300 at an inner boss 2262 of the distal end cap 2260. Of course, the connections of the end caps 2250, 2260 to the outer can 2300 are not limited to the device shown in these drawings and can take any form. FIGS. 24 and 25 show the baffle 2240 in various stages of production As can be seen in these figures, the volumes of the first baffle chamber 2242 and the second baffle chamber 2244 merge together due to the narrowed shape of the first baffle wall 2246. In this configuration, most of the gas emerging from the barrel 2210 hits the proximal side of the first baffle wall 2246 and is directed backwards towards the barrel 2210 and into the first chamber 2340 surrounding the barrel 2210. This first chamber 2340 is relatively very large as compared to the total volume of the distal baffle chambers 2248. The gases passing through the bore of the first baffle wall 2246 (a small percentage of the total) are, again, directed backwards towards the barrel 2210 and into the first chamber, 2340. As such, a great percentage of the gas (around 80%) is contained within the first two baffle chambers 2340, 2243, 2244. This significantly enlarged volume lowers the gas pressure much more than previous suppressors as it exits the last baffle/bulkhead to the atmosphere. Depressions 2264 are provided in the end cap 2260 for installing (e.g., screwing) the end cap 2260 into the outer can 2300.

These first two baffle stages 2340, 2242, 2244 act as a muzzle brake by redirecting the gases rearward towards the large plenum reservoir volume to reduce the total gas pressure. In the configuration illustrated, the first baffle stage 2242 has a longer-than-normal stand off distance from the barrel muzzle to allow maximum expansion of the gas as the bullet leaves the barrel 2210, thereby maximizing the amount of gas that is redirected rearward. As the bullet travels through the second baffle 2244, any gas that goes thru the first bore hole is also allowed to expand and be redirected rearward. The rest of the baffle stages three through seven act as standard silencer baffles.

Typical barrel lengths for AR-15 or M-16-type rifles range from eight inches to sixteen inches. If a small barrel length of eight inches, for example, is selected and the distance from the distal end of the barrel 2210 to the distal end of baffle 2240 is also eight inches, then the inventive silencer configuration produces a 16-inch silencer. Compared to prior art silencers that are screwed onto the distal end of the barrel 2210, this means that the inventive silencer doubles the interior volume of the silencer without adding any extra radius or longitudinal length past the barrel end. This means that suppression effect of the inventive silencer should be half that of prior art screw-type silencers.

Other significant benefits arise from this particular rifle suppressor configuration.

An owner must pay a $200 BATF Tax Stamp to have a silencer. If the owner wants to have a Short Barrel Rifle (SBR), Federal Law requires that owner to pay an additional SBR Tax Stamp. (An SBR is a rifle having a barrel less than sixteen inches in length.) Simple mathematics shows that there is importance to minimize the number of tax stamps required to be paid by a firearm owner.

If the owner uses an eight-inch suppressor on the end of a sixteen-inch barrel, then the barrel's total length will be twenty-four inches, a length that is not preferred by many firearm users. Many people prefer a silencer assembly that keeps the barrel length to be no more than sixteen inches. But, to have that short of a length with a silencer, the user must use an SBR (and, therefore, pay the SBR Tax Stamp). The inventive silencer configuration allows the total barrel size to be reduced while eliminating the need to pay for the SBR Tax Stamp. More particularly, if the barrel length of the carbine is desired to be sixteen inches and barrel used is nine inches, then the baffle stack can be no more than seven inches at the distal end of the barrel. In prior art silencers, this would mean that the silencer is less than seven inches in length and the rifle is an SBR. But, because the end caps 2250, 2260, the outer can 2300, and the baffle 2200 of the invention are integral with the short barrel 2210, these items count in the calculation of total barrel length. Thus, for the inventive silencer, the first nine inches of the barrel is a plenum reservoir for diverted gases and the last seven inches hold the baffle chamber. This integral configuration means that the barrel is sixteen inches in length—removing the gun from consideration as an SBR.

Figures 26, 27, 28, 29:
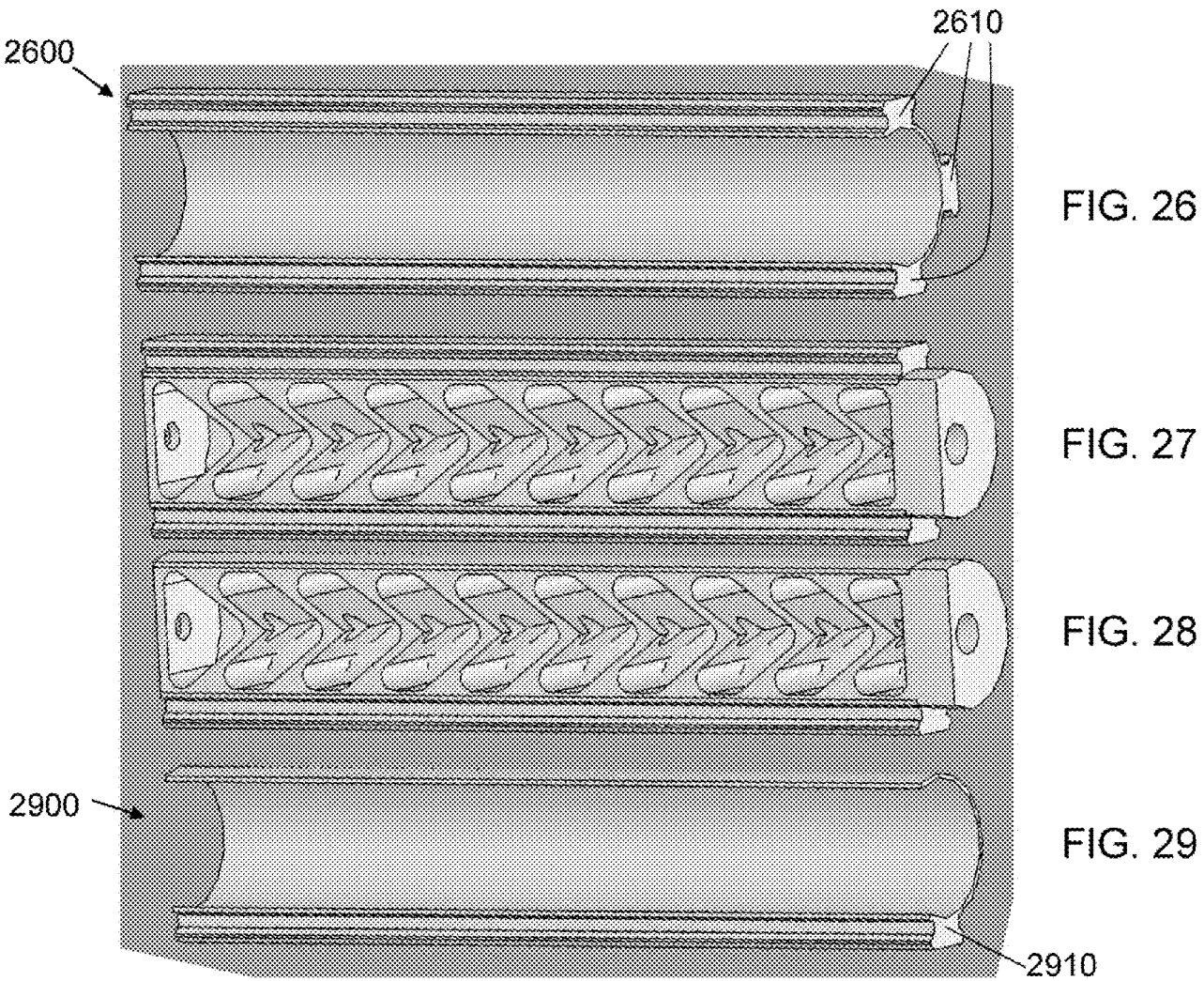
FIG. 26 is a perspective view of a non-centered longitudinal cross section of an exemplary outer can according to the invention with a four-rail Picatinny system.
FIG. 27 is a perspective view of a non-centered longitudinal cross section of the outer can of FIG. 26 and an exemplary inner baffle according to the invention.
FIG. 28 is a perspective view of a non-centered longitudinal cross section of the outer can of FIG. 29 and the exemplary inner baffle of FIG. 27.
FIG. 29 is a perspective view of a non-centered longitudinal cross section of an exemplary outer can according to the invention with a single-rail Picatinny system.

As can be seen from the configuration of FIG. 23, the outer surface of the can 2300 is a smooth cylinder. Most rifles, however, are not smooth and have various features to permit attachment of accessories to the rifle. Such accessories include various sights, lasers, lights, to name a few. Due to the configuration of the suppressor system of FIGS. 22 to 25, the outer surface of the can 2300 is free to be modified. If made from an aluminum tube extrusion, the can 2300 is able to have various shapes integral with the cylinder itself, one of which includes one or more Picatinny rails. The can 2600 configuration shown in FIGS. 26 and 27 has four Picatinny rails 2610 (one of which is absent due to the cross-sectional view. In comparison, the can 2900 configuration shown in FIGS. 28 and 29 has a single lower Picatinny rail 2910. As such, the lower rail 2610, 2910 can be used to hold a vertical adjustable Picatinny rail handle, for example. Other accessories could be added to any of these rails 2600, 2900 and the rails can be in any number or at any location around the outer surface of the can 2300.

The foregoing description and accompanying drawings illustrate the principles, preferred embodiments and modes of operation of the invention. More specifically, the firearm suppressor and the methods for manufacturing and fastening the suppressor onto a firearm have been described with respect to a silencer. However, the invention should not be construed as being limited to the particular embodiments discussed above. Additional variations of the embodiments discussed above will be appreciated by those skilled in the art as well as for applications, unrelated to silencers.

The above-described embodiments should be regarded as illustrative rather than restrictive. Accordingly, it should be appreciated that variations to those embodiments can be made by those skilled in the art without departing from the scope of the invention as defined by the following claims.

We claim:

1. A firearm suppressor, comprising:

a one-piece, hollow outer can defining an interior with a cross-sectional shape and having:

a longitudinal can length;

an interior-threaded proximal end; and a radially closed distal end with a longitudinal can bore opening the interior of the can to the environment, the longitudinal can bore having a diameter sufficient to permit a projectile to pass therethrough;

a monolithic extruded baffle having:

a longitudinal extent;

a proximal end portion defining a proximal longitudinal bore shaped to receive at least a portion of a firearm barrel and removably secure thereto;

a distal end portion defining a distal longitudinal bore with a diameter sufficient to permit a projectile to pass therethrough; and intermediate baffle walls disposed between the proximal end and the distal end and defining at least one proximal baffle wall and at least one distal baffle wall, each baffle wall having a longitudinal bore axially aligned with the proximal longitudinal bore and the distal longitudinal bore, the at least one distal baffle wall extending radially outward to a shape substantially equal to the cross-sectional shape of the outer can to substantially prevent fluid from passing through the at least one distal baffle wall other than through the longitudinal bore, the at least one proximal baffle wall extending radially outward to a shape substantially less than the cross-sectional shape of the outer can to substantially permit fluid to pass through the at least one proximal baffle wall in addition to through the proximal longitudinal bore;

a barrel nut having an interior barrel bore shaped to receive at least a portion of a firearm barrel therethrough and an outer-threaded distal end corresponding to the interior-threaded proximal end of the outer can to removably secure the outer can thereto the barrel nut being operable to secure a firearm barrel to a firearm; and the longitudinal can length being greater than the longitudinal extent of the extruded baffle such that, when installed on the firearm, the outer can seals the extruded baffle therein and extends from approximately the distal end of the baffle proximally to the barrel nut.

2. The suppressor according to claim 1, wherein the proximal end, the distal end, and the central baffle walls are simultaneously extruded.

3. The suppressor according to claim 1, wherein the proximal end, the distal end, and the central baffle walls are shaped from a simultaneous extrusion.

4. The suppressor according to claim 1, wherein the at least one distal baffle wall is a set of baffle walls being between two and ten in number.

5. The suppressor according to claim 1, wherein the at least one proximal baffle wall is two proximal baffle walls each extending radially outward to a shape substantially less than the cross-sectional shape of the outer can to substantially permit fluid to pass therethrough in addition to through the longitudinal bore.

6. The suppressor according to claim 1, wherein the outer can is a single drawn can with an integral closed distal end having the longitudinal bore.

7. The suppressor according to claim 1, further comprising a distal end cap separate from the outer can and fixedly attached to the distal opening of the can and to close the outer can, the distal end cap having the longitudinal bore.

8. The suppressor according to claim 4, wherein:

each pair of adjacent distal baffle walls define a plenum therebetween having a maximum longitudinal extent; and when installed on the firearm, the barrel nut and the at least one proximal baffle wall define a first plenum therebetween having a longitudinal extent greater than the maximum longitudinal extent.

9. The suppressor according to claim 4, wherein:

each pair of adjacent distal baffle walls define a plenum therebetween having a maximum longitudinal extent; and when installed on the firearm, the barrel nut and the at least one proximal baffle wall have a separation distance therebetween greater than the maximum longitudinal extent.

10. A firearm suppressor, comprising:

a one-piece, hollow outer can defining an interior with a cross-sectional shape and having:

a longitudinal can length;

a first connection area; and a radially closed distal end with a longitudinal can bore opening the interior of the can to the environment, the longitudinal can bore having a diameter sufficient to permit a projectile to pass therethrough;

a monolithic extruded baffle having:

a longitudinal extent;

a proximal end portion defining a proximal longitudinal bore shaped to receive at least a portion of a firearm barrel and removably secure thereto;

a distal end portion defining a distal longitudinal bore with a diameter sufficient to permit a projectile to pass therethrough; and intermediate baffle walls disposed between the proximal end and the distal end and defining at least one proximal baffle wall and at least one distal baffle wall, each baffle wall having a longitudinal bore axially aligned with the proximal longitudinal bore and the distal longitudinal bore, the at least one distal baffle wall extending radially outward to a shape substantially equal to the cross-sectional shape of the outer can to substantially prevent fluid from passing through the at least one distal baffle wall other than through the longitudinal bore, the at least one proximal baffle wall extending radially outward to a shape substantially less than the cross-sectional shape of the outer can to substantially permit fluid to pass through the at least one proximal baffle wall in addition to through the proximal longitudinal bore;

a barrel nut having an interior barrel bore shaped to receive at least a portion of a firearm barrel therethrough and a second connection area operable, with the first connection area, to removably secure the outer can thereto, the barrel nut being operable to secure a firearm barrel to a firearm; and the longitudinal can length being greater than the longitudinal extent of the extruded baffle such that, when installed on the firearm, the outer can seals the extruded baffle therein and extends from approximately the distal end of the baffle proximally to the barrel nut.

11. The suppressor according to claim 10, wherein the proximal end, the distal end, and the central baffle walls are simultaneously extruded.

12. The suppressor according to claim 10, wherein the proximal end, the distal end, and the central baffle walls are shaped from a simultaneous extrusion.

13. The suppressor according to claim 10, wherein the at least one distal baffle wall is a set of baffle walls being between two and ten in number.

14. The suppressor according to claim 10, wherein the at least one proximal baffle wall is two proximal baffle walls each extending radially outward to a shape substantially less than the cross-sectional shape of the outer can to substantially permit fluid to pass therethrough in addition to through the longitudinal bore.

15. The suppressor according to claim 10, wherein the outer can is a single drawn can with an integral closed distal end having the longitudinal bore.

16. The suppressor according to claim 10, further comprising a distal end cap separate from the outer can and fixedly attached to the distal opening of the can and to close the outer can, the distal end cap having the longitudinal bore.

17. The suppressor according to claim 13, wherein:

each pair of adjacent distal baffle walls define a plenum therebetween having a maximum longitudinal extent; and when installed on the firearm, the barrel nut and the at least one proximal baffle wall define a first plenum therebetween having a longitudinal extent greater than the maximum longitudinal extent.

18. The suppressor according to claim 13, wherein:

each pair of adjacent distal baffle walls define a plenum therebetween having a maximum longitudinal extent; and when installed on the firearm, the barrel nut and the at least one proximal baffle wall have a separation distance therebetween greater than the maximum longitudinal extent.

* * * * *